US008805220B2

(12) United States Patent
Bucks

(10) Patent No.: US 8,805,220 B2
(45) **Date of Patent: *Aug. 12, 2014**

(54) PRINTER WITH MULTI-TONER DISCHARGED AREA DEVELOPMENT

(75) Inventor: Rodney Ray Bucks, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 148 days.

This patent is subject to a terminal disclaimer.

(21) Appl. No.: 13/454,118

(22) Filed: Apr. 24, 2012

(65) Prior Publication Data

US 2013/0279949 A1 Oct. 24, 2013

(51) Int. Cl.
*G03G 15/08* (2006.01)

(52) U.S. Cl.
USPC ..... 399/53; 399/51; 399/285

(58) Field of Classification Search
USPC ..... 399/39, 40, 51, 53, 58
See application file for complete search history.

(56) References Cited

U.S. PATENT DOCUMENTS

| | | | | |
|---|---|---|---|---|
| 3,724,422 | A | 4/1973 | Latone et al. | |
| 3,927,641 | A | 12/1975 | Handa | |
| 4,041,903 | A | 8/1977 | Katakura et al. | |
| 5,234,783 | A | 8/1993 | Ng | |
| 5,905,012 | A | 5/1999 | De Meutter et al. | |
| 5,926,679 | A | 7/1999 | May et al. | |
| 6,608,987 | B2 | 8/2003 | Bartscher et al. | |
| 6,880,463 | B2 | 4/2005 | DeMeulemeester et al. | |
| 7,016,621 | B1 | 3/2006 | Ng | |
| 7,120,379 | B2 | 10/2006 | Eck et al. | |
| 7,389,073 | B2 | 6/2008 | Kamar et al. | |
| 2002/0168200 | A1 | 11/2002 | Stelter et al. | |
| 2006/0109491 | A1 * | 5/2006 | Naito et al. | 358/1.13 |
| 2007/0172260 | A1 * | 7/2007 | Fukuda et al. | 399/223 |
| 2009/0162113 | A1 | 6/2009 | Solcz et al. | |
| 2012/0099879 | A1 * | 4/2012 | Aslam et al. | 399/53 |
| 2012/0251143 | A1 * | 10/2012 | Fowlkes et al. | 399/53 |
| 2013/0279948 | A1 * | 10/2013 | Bucks | 399/285 |

FOREIGN PATENT DOCUMENTS

| | | |
|---|---|---|
| JP | 62-049377 | 3/1987 |
| JP | 2000-231279 | 8/2000 |
| JP | 2005-189719 | 7/2005 |
| JP | 2007-328061 | 12/2007 |

OTHER PUBLICATIONS

IS & T's 1997 International Conference on Digital Printing Technologies, UV-cured Toners for Printing and Coating on Paper-like Substrates, pp. 168-172, Detlef Schuzle-Hagenest, Micheal Huber, Saskia Udding-Louwrier and Paul H.G. Binda.

* cited by examiner

*Primary Examiner* — David Gray
*Assistant Examiner* — Thomas Giampaolo, II
(74) *Attorney, Agent, or Firm* — Roland R. Schindler, II

(57) ABSTRACT

Printers are provided in which a charge pattern is formed with a first area having a surface potential that is at least 30 percent less than a surface potential of an adjacent second area that creates an inter-area field between the first area and second area that extends into a portion of the first area that is proximate to the second area. A development station applies a first development field and a first toner is partially developed in the first area based upon the influence of the inter-area and first development fields. The charge pattern and first toner are further developed with a different second toner. The surface charge, the first toner and second toner have the same polarity.

19 Claims, 20 Drawing Sheets

PRINTER WITH MULTI-TONER DISCHARGED AREA DEVELOPMENT

CROSS REFERENCE TO RELATED APPLICATIONS

This application relates to commonly assigned, copending U.S. application Ser. No. 13/454,119, filed Apr. 24, 2012, entitled: "MULTI-TONER CHARGED AREA DEVELOPMENT METHOD"; U.S. application Ser. No. 13/454,117, filed Apr. 24, 2012, entitled: "MULTI-TONER DISCHARGED AREA DEVELOPMENT METHOD", and U.S. application Ser. No. 13/454,119, filed Apr. 24, 2012, entitled: "PRINTER WITH MULTI-TONER CHARGED AREA DEVELOPMENT", each of which is hereby incorporated by reference.

FIELD OF THE INVENTION

This invention pertains to the field of printing.

BACKGROUND OF THE INVENTION

Color toner printers provide full color images by building up and sequentially transferring individual color separation toner images in registration onto a receiver and fusing the toner and receiver. Specific color outcomes are achieved in such printers because controlled ratios of differently colored toners are applied in combination to create the appearance of a desired color at specific locations on a receiver. Similarly, as is described in U.S. Patent Publication Number: US20090286177A1, entitled: "Adjustable Gloss Document Printing", different toners such as high viscosity toners can be used in combination with lower viscosity toners to allow a user to obtain a desired gloss level at specific locations by controlling the ratio of two different types of toners at the locations. It will be appreciated that many other desirable printing outcomes can be achieved using ratio controlled combinations of toners.

In tandem type toner printers, separate toner images are generated in individual toner printing modules and the different toners to be applied at a specific location on a printer are combined when the separate toner images are transferred onto a common surface. Accordingly, variations in the way in which the individual toner printing modules generate toner images and variations in the registration of the individual toner images during transfer can create unintended combinations of toner.

It is a continuing objective in the toner printing arts to provide printing systems and methods that can reliably and controllably deliver precise combinations of two or more toners in very small controlled patterns on a receiver. This is driven among other things by requirements for increased image quality, security printing features such as authentication markings, and functional printing objectives. Accordingly, there is an ongoing desire in the printing industry to provide increasing smaller areas in which combinations of toners can reliably be formed in controlled patterns.

In toner printing, toner is developed on a surface having a charge pattern. In analog systems, a charge pattern is formed on the surface in response to an optical image. This form of image patterning can form any of a vast range of different image intensities and depending on the way in which the surface reacts to the image, the charge pattern can include an equally wide range of different charge patterns.

In digital printing systems, a digitally controlled writer generates a charge pattern. Such writers provide a fixed number of individually addressable areas which represent the smallest portions of the surface on which different charge levels can be defined by the writer. The writer also has a fixed number of writing levels that it can generate to form the charge pattern. For a given printing system, the size of the individually addressable areas is fixed as is the number of different charge levels that can be assigned to an individually addressable area.

What is needed in the art is a new approach to toner printing that enables the formation of controlled patterns of more than one toner at sizes that are smaller than the presently available addressable areas of such toner printers.

SUMMARY OF THE INVENTION

Printers are provided. In one aspect a printer has a print engine having a primary imaging member on which a charge pattern can be formed, and a writing system generating the charge pattern of a first polarity on a primary imaging member including a first area having a first imagewise modulated surface potential relative to ground and a second area having an imagewise modulated surface potential relative to ground that is at least about 30% greater than the first imagewise modulated surface potential so that an inter-area field forms having a component that extends from the second area into an edge proximate portion of the first area, a first development system and a second development system. The first development system partially develops the charge pattern with a first toner having a first polarity using a first development field to urge the first toner to develop in the first area in amounts that increase with increases in a first net development difference of potential between a first bias voltage at a first development station and a first imagewise modulated surface potential in the first area with the component of the inter-area field that extends into the first area further urging development of first toner in the edge proximate portion of the first area so that there is at least 15% more first toner per unit area in the edge proximate portion of the first area than in a remaining portion of the first area. The second development system further develops the charge pattern and a first toner image with a second toner having the first polarity using a second development field that urges the second toner to develop in the first area in amounts that increase with increases in a difference of potential between a second bias voltage and the first surface potential which is modulated by the charge of the first toner developed in the first area to urge the second toner to develop predominately in the remaining portion of the first area wherein the first toner and the second toner are different.

DETAILED DESCRIPTION OF THE INVENTION

Figure 1:
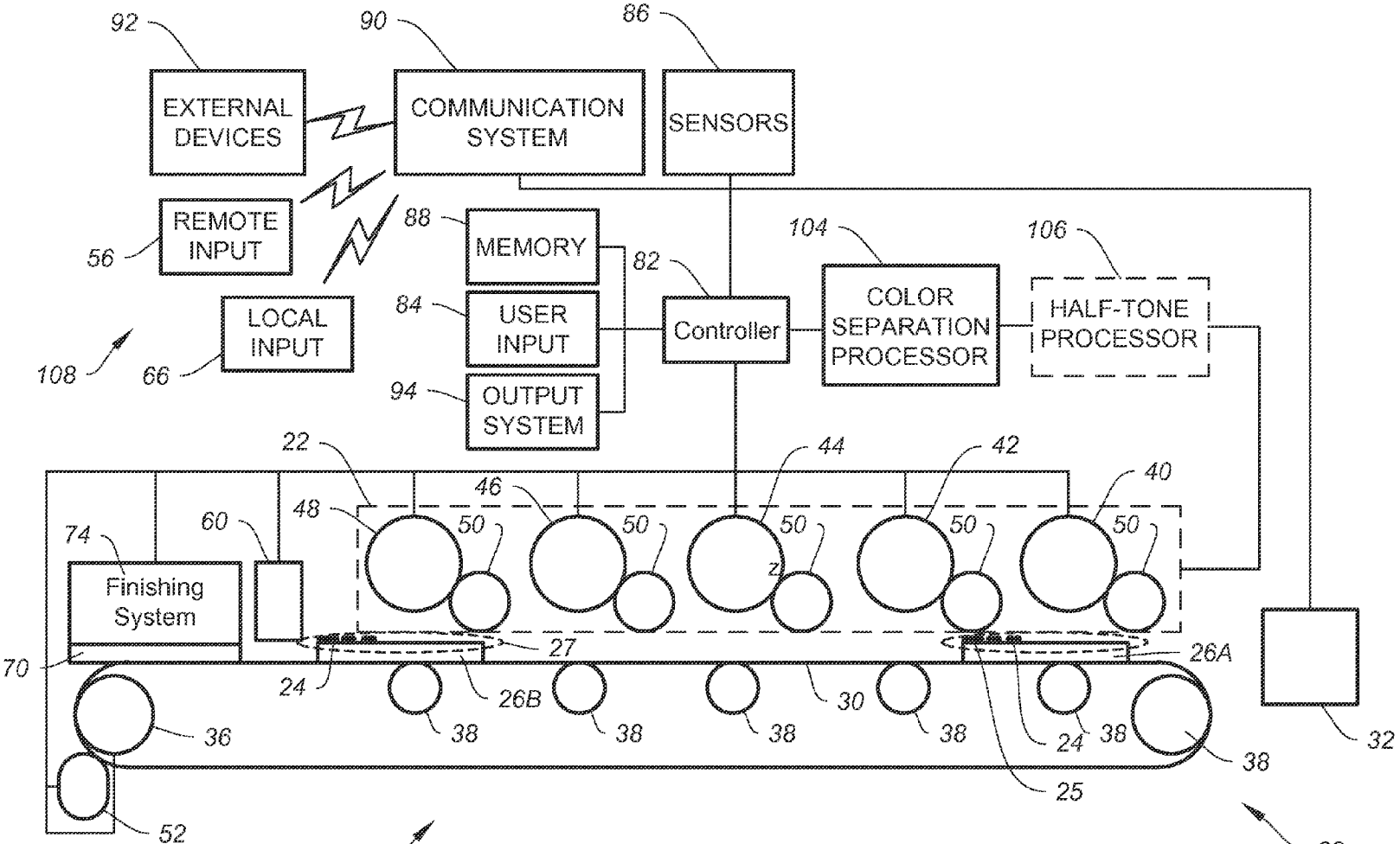
FIG. 1 is a system level illustration of a toner printer.

FIG. 1 is a system level illustration of a toner printer 20. In the embodiment of FIG. 1, toner printer 20 has a print engine 22 of an electrophotographic type that deposits toner 24 to form a toner image 25 in the form of a patterned arrangement of toner stacks. Toner image 25 can include any patternwise application of toner 24 and can be mapped according to data representing text, graphics, photo, and other types of visual content, as well as patterns that are determined based upon desirable structural or functional arrangements of the toner 24.

Toner 24 is a material or mixture that contains toner particles and that can form an image, pattern, or indicia when electrostatically deposited on an imaging member including a photoreceptor, photoconductor, or electrostatically-charged surface. As used herein, "toner particles" are the particles that are electrostatically transferred by print engine 22 to form a pattern of material on a receiver 26 to convert an electrostatic latent image into a visible image or other pattern of toner 24 on receiver 26. Toner particles can also include clear particles that have the appearance of being transparent or that while being generally transparent impart a coloration or opacity. Such clear toner particles can provide for example a protective layer on an image or can be used to create other effects and properties on the image. The toner particles are fused or fixed to bind toner 24 to a receiver 26.

Toner particles can have a range of diameters, e.g. less than 4 μM, on the order of 5-15 μm, up to approximately 30 μm, or larger. When referring to particles of toner 24, the toner size or diameter is defined in terms of the mean volume weighted diameter as measured by conventional diameter measuring devices such as a Coulter Multisizer, sold by Coulter, Inc. The mean volume weighted diameter is the sum of the volume of each toner particle multiplied by the diameter of a spherical particle of equal volume, divided by the total particle volume. Toner 24 is also referred to in the art as marking particles or dry ink. In certain embodiments, toner 24 can also comprise particles that are entrained in a liquid carrier.

Typically, receiver 26 takes the form of paper, film, fabric, metalized or metallic sheets or webs. However, receiver 26 can take any number of forms and can comprise, in general, any article or structure that can be moved relative to print engine 22 and processed as described herein.

Print engine 22 has one or more printing modules, shown in FIG. 1 as printing modules 40, 42, 44, 46, and 48 that are each used to deliver a single application of toner 24 to form a toner image 25 on receiver 26. For example, the toner image 25 shown formed on receiver 26A in FIG. 1 can provide a monochrome image or layer of a structure or other functional material or shape.

Print engine 22 and a receiver transport system 28 cooperate to deliver one or more toner image 25 in registration to form a composite toner image 27 such as the one shown formed in FIG. 1 as being formed on receiver 26B. Composite toner image 27 can be used for any of a plurality of purposes, the most common of which is to provide a printed image with more than one color. For example, in a four color image, four toner images are formed with each toner image having one of the four subtractive primary colors, cyan, magenta, yellow, and black. These four color toners can be combined to form a representative spectrum of colors. Similarly, in a five color image various combinations of any of five differently colored toners can be combined to form a color print on receiver 26. That is, any of the five colors of toner 24 can be combined with toner 24 of one or more of the other colors at a particular location on receiver 26 to form a color after a fusing or fixing process that is different than the colors of the toners 24 applied at that location.

In FIG. 1, print engine 22 is illustrated as having an optional arrangement of five printing modules 40, 42, 44, 46, and 48, also known as electrophotographic imaging subsystems arranged along a length of receiver transport system 28. Each printing module delivers a single toner image 25 to a respective transfer subsystem 50 in accordance with a desired pattern. The respective transfer subsystem 50 transfers the toner image 25 onto a receiver 26 as receiver 26 is moved by receiver transport system 28. Receiver transport system 28 comprises a movable surface 30 that positions receiver 26 relative to printing modules 40, 42, 44, 46, and 48. In this embodiment, movable surface 30 is illustrated in the form of an endless belt that is moved by motor 36, that is supported by rollers 38, and that is cleaned by a cleaning mechanism 52. However, in other embodiments receiver transport system 28 can take other forms and can be provided in segments that operate in different ways or that use different structures. In an alternate embodiment, not shown, printing modules 40, 42, 44, 46 and 48 can each deliver a single application of toner 24 to a transfer subsystem 50 to form a combination toner image thereon which can be transferred to a receiver.

Printer 20 is operated by a printer controller 82 that controls the operation of print engine 22 including but not limited to each of the respective printing modules 40, 42, 44, 46, and 48, receiver transport system 28, receiver supply 32, and transfer subsystem 50, to cooperate to form toner images 25 in registration on a receiver 26 or an intermediate in order to yield a composite toner image 27 on receiver 26 and to cause fuser 60 to fuse composite toner image 27 on receiver 26 to form a print 70 as described herein or otherwise known in the art. Receiver transport system 28 can also advance receiver 26 to an optional finishing system 74 that can perform any of a wide variety of finishing operations on the print 70.

Printer controller 82 operates printer 20 based upon input signals from a user input system 84, sensors 86, a memory 88 and a communication system 90. User input system 84 can comprise any form of transducer or other device capable of receiving an input from a user and converting this input into a form that can be used by printer controller 82. Sensors 86 can include contact, proximity, electromagnetic, magnetic, or optical sensors and other sensors known in the art that can be used to detect conditions in printer 20 or in the environment-surrounding printer 20 and to convert this information into a form that can be used by printer controller 82 in governing printing, fusing, finishing or other functions.

Memory 88 can comprise any form of conventionally known memory devices including but not limited to optical, magnetic or other movable media as well as semiconductor or other forms of electronic memory. Memory 88 can contain for example and without limitation image data, print order data, printing instructions, suitable tables and control software that can be used by printer controller 82.

Communication system 90 can comprise any form of circuit, system or transducer that can be used to send signals to or receive signals from memory 88 or external devices 92 that are separate from or separable from direct connection with printer controller 82. External devices 92 can comprise any type of electronic system that can generate signals bearing data that may be useful to printer controller 82 in operating printer 20.

Printer 20 further comprises an output system 94, such as a display, audio signal source or tactile signal generator or any other device that can be used to provide human perceptible signals by printer controller 82 to feedback, informational or other purposes.

Printer 20 prints images based upon print order information. Print order information can include image data for printing and printing instructions from a variety of sources. In the embodiment of FIG. 1, these sources include memory 88, communication system 90, that printer 20 can receive such image data through local generation or processing that can be executed at printer 20 using, for example, user input system 84, output system 94 and printer controller 82. Print order information can also be generated by way of remote input 56 and local input 66 and can be calculated by printer controller 82. For convenience, these sources are referred to collectively herein as source of print order information 108. It will be appreciated, that this is not limiting and that source of print order information 108 can comprise any electronic, magnetic, optical or other system known in the art of printing that can be incorporated into printer 20 or that can cooperate with printer 20 to make print order information or parts thereof available.

In the embodiment of printer 20 that is illustrated in FIG. 1, printer controller 82 has a color separation image processor 104 to convert the image data into color separation images that can be used by printing modules 40-48 of print engine 22 to generate toner images. An optional half-tone processor 106 is also shown that can process the color separation images according to any half-tone screening requirements of print engine 22.

Figure 2A:
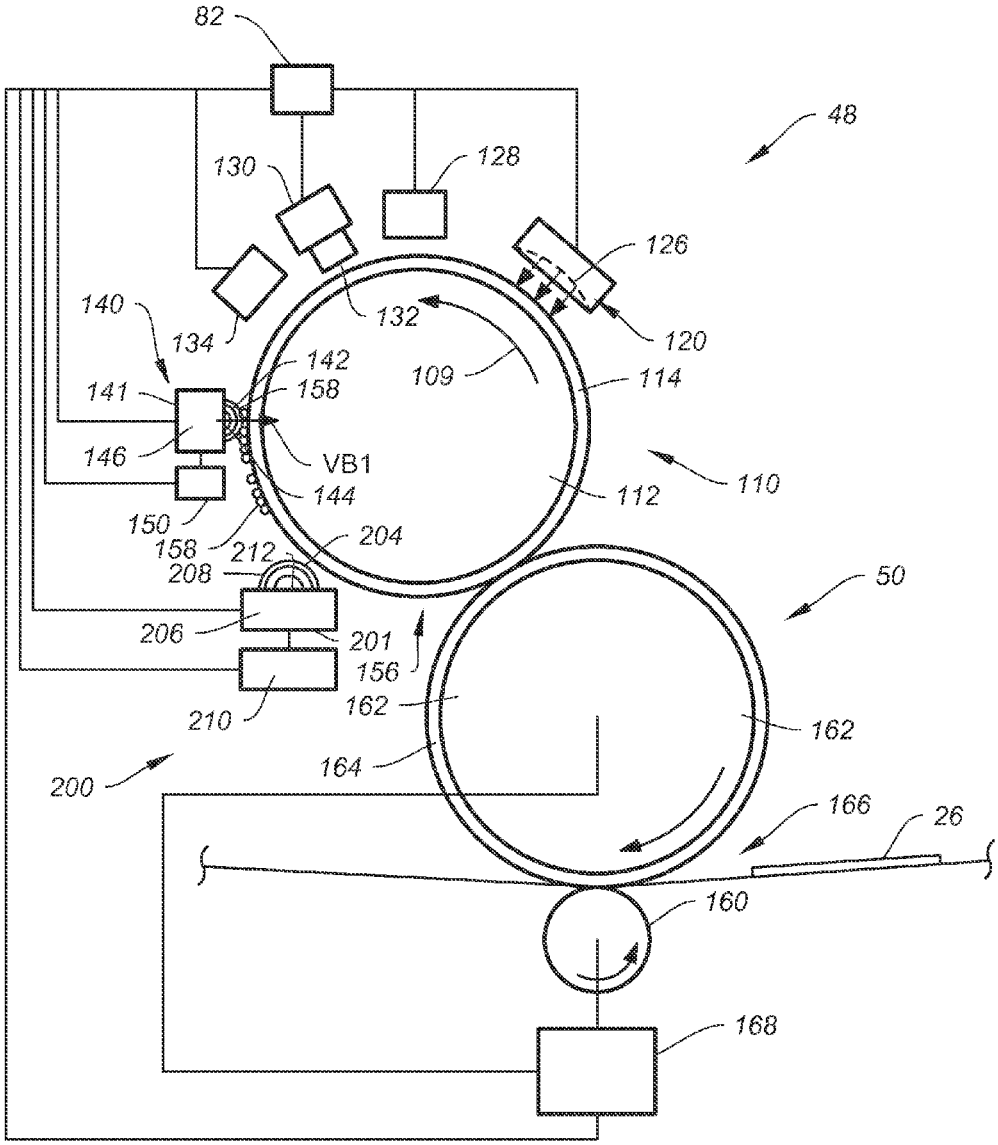
FIGS. 2A-2C illustrates a first embodiment of a printing module having a second development system.
Figure 2B:
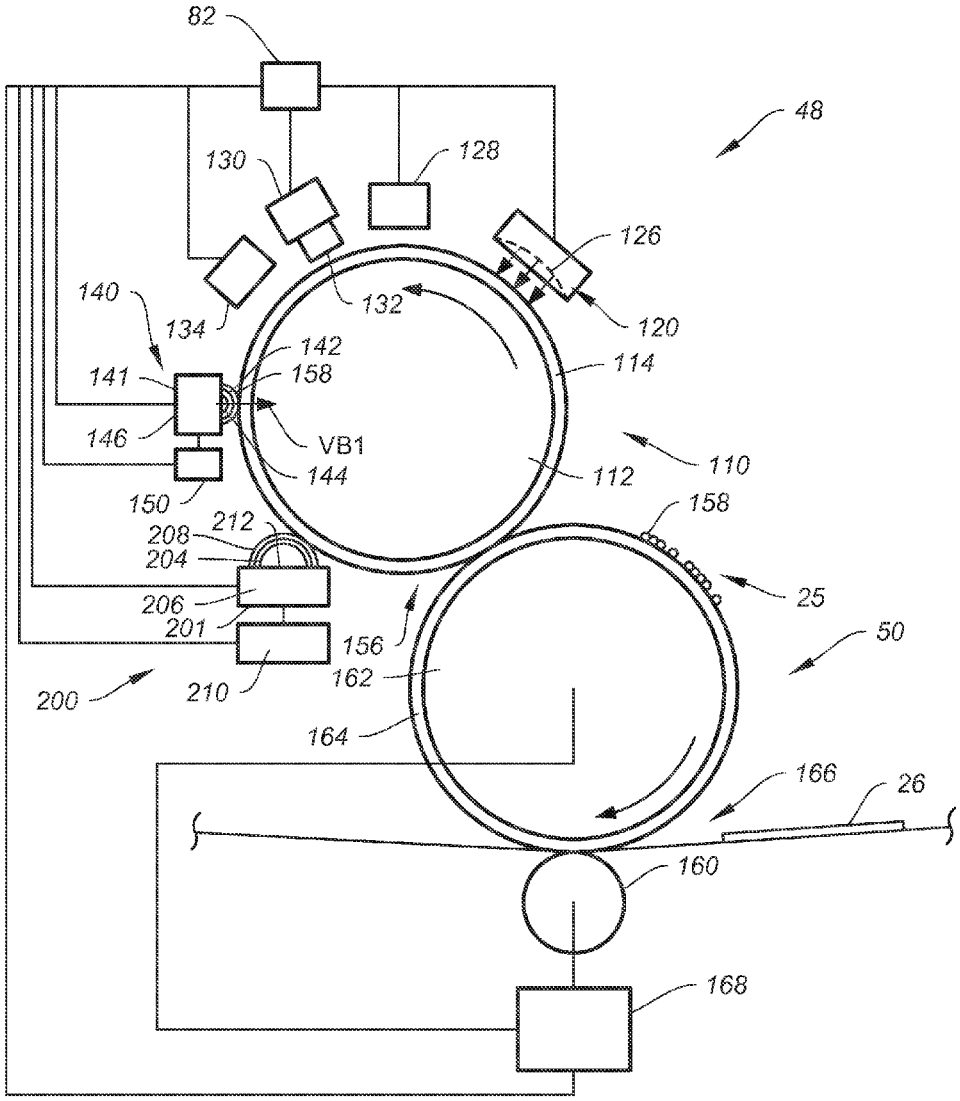
Figure 2C:
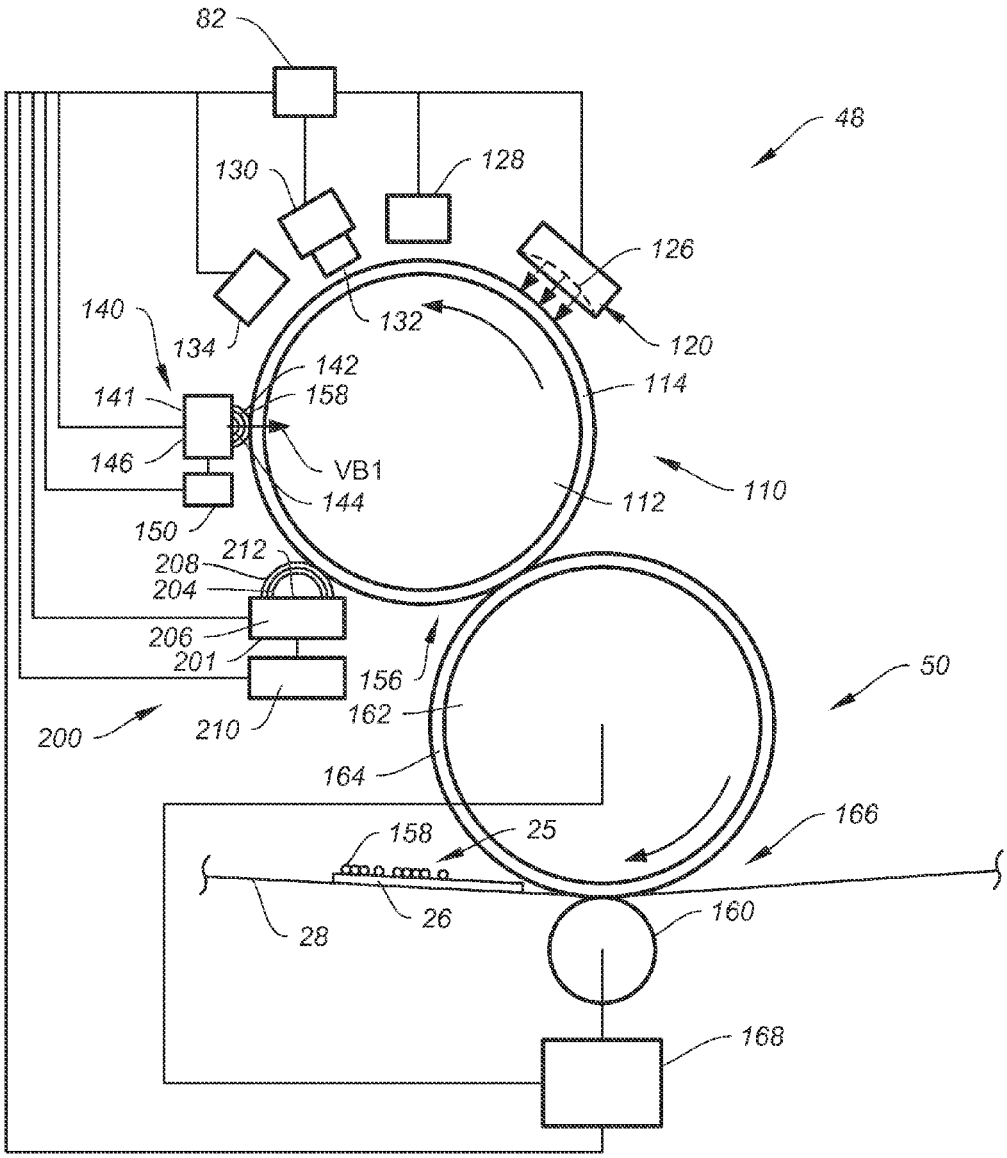

FIGS. 2A-2C illustrate a first embodiment of a printing module 48 that is representative of printing modules 40, 42, 44, and 46 of FIG. 1. In this embodiment, printing module 48 has a primary imaging system 110, a charging subsystem 120, a writing system 130, a first development system 140 and a second development system 200 that are each ultimately responsive to printer controller 82. Each printing module can also have its own respective local controller (not shown) or hardwired control circuits (not shown) to perform local control and feedback functions for an individual module or for a subset of the printing modules. Such local controllers or local hardwired control circuits are coupled to printer controller 82.

In the embodiment of FIGS. 2A-3C, primary imaging system 110 includes a primary imaging member 112, charging subsystem 120 and writing system 130. In this embodiment, primary imaging member 112 takes the form of an imaging cylinder. However, in other embodiments primary imaging member 112 can take other forms, such as a belt or plate. As is indicated by arrow 109 in FIGS. 2A-2C, primary imaging member 112 is rotated by a motor (not shown) such that primary imaging member 112 rotates from charging subsystem 120, to writing system 130 to first development system 140 and into a transfer nip 156 with a transfer subsystem 50.

In the embodiment of FIGS. 2A-2C, primary imaging member 112 has a photoreceptor 114. Photoreceptor 114 includes a photoconductive layer formed on an electrically conductive substrate. The photoconductive layer is an insulator in the substantial absence of light so that patterns of different surface charges can be formed and retained at specific locations on the photoconductive layer. When an area of a photoreceptor 114 is exposed to light, the photoconductor in that area becomes conductive and dissipates some charge of the photoreceptor in the exposed area. The dissipation can be total or partial depending on the extent of the exposure. In various embodiments, photoreceptor 114 is part of, or disposed over, the surface of primary imaging member 112. Photoreceptor layers can include a homogeneous layer of a single material such as vitreous selenium or a composite layer containing a photoconductor and another material.

Charging subsystem 120 is configured as is known in the art, to apply charge to photoreceptor 114. The charge applied by charging subsystem 120 creates a generally uniform initial surface potential VI relative to ground on photoreceptor 114. For the purposes of this discussion ground is considered to be zero volts. The initial surface potential VI has a first polarity which can, for example, be a negative polarity. Here, charging subsystem 120 includes a grid 126 that is selected and driven by a power source (not shown) to control the charging of photoreceptor 114. Other charging systems can also be used.

In this embodiment, an optional meter 128 is provided that measures the surface potential on primary imaging member 112 after initial charging and that provides feedback to, in this example, printer controller 82, allowing printer controller 82 to send signals to adjust settings of the charging subsystem 120 to help charging subsystem 120 to operate in a manner that creates a desired initial surface potential VI on primary imaging member 112. In other embodiments, a local controller or analog feedback circuit or the like can be used for this purpose.

Writing system 130 is provided having a writer 132 that forms charge patterns on a primary imaging member 112. In this embodiment, this is done by exposing primary imaging member 112 to electromagnetic or other radiation that is modulated according to color separation image data to form a latent electrostatic image (e.g., of a color separation corresponding to the color or colors of toner deposited at printing module 48) and that causes primary imaging member 112 to have image modulated charge patterns thereon.

In the embodiment shown in FIGS. 2A-2C, writing system 130 exposes the uniformly-charged photoreceptor 114 of primary imaging member 112 to actinic radiation provided by selectively activated light sources in an LED array or a modulated laser device outputting light directed at photoreceptor 114. In embodiments using laser devices, a rotating polygon (not shown) is used to scan one or more laser beam(s) across the photoreceptor in the fast-scan direction. One individually addressable area is exposed at a time by each laser beam, and the intensity or duty cycle of the laser beam is varied at each individually addressable area. In embodiments using an LED array, the array can include a plurality of LEDs arranged next to each other in a line, all individually addressable areas in one row of individually addressable areas on the photoreceptor can be selectively exposed simultaneously, and the intensity or duty cycle of each LED can be varied within a line exposure time to expose each individually addressable area in the row during that line exposure time. While various embodiments described herein describe the formation of an imagewise modulated charge pattern on a primary imaging member 112 by using a photoreceptor 114 and optical type writing system 130, such embodiments are exemplary and any other system method or apparatuses known in the art for forming an imagewise pattern of surface potential on a primary imaging member 112 consistent with what is described or claimed herein can be used for this purpose.

As used herein, an "engine pixel" is the smallest addressable unit of primary imaging member 112. As shown in this embodiment primary imaging member 112 has a photoreceptor 114 that writer 132 (e.g., a light source, laser or LED) can expose with a selected exposure different from the exposure of another engine pixel. Engine pixels can overlap, e.g. to increase addressability in the slow-scan direction. Each engine pixel has a corresponding engine pixel location on an image and the exposure applied to the engine pixel location is described by an engine pixel level. The imagewise surface potential pattern is determined based upon the density of the color separation image being printed by printing module 48.

In the embodiments described herein, writing system 130 uses a write-black or discharged-area development (DAD) writing model where imagewise exposure of the primary imaging member 112 assumes that toner will develop on the primary imaging member at engine pixel locations in proportion to the extent to which the initial surface potential VI is discharged during writing. In such a system the amount of toner that is developed at an engine pixel location is generally proportional to the exposure at the engine pixel location. In the embodiment of FIGS. 2A-2C, the exposure of photoreceptor 114 to imagewise modulated light causes partial or total discharge of the initial surface potential VI at individual engine pixel locations yielding an imagewise modulated surface potential VEPL at each of the engine pixel locations.

It will be appreciated that the process for converting image data into exposure levels to be generated by writer 132 are made in accordance with this DAD model and that any or all of printer controller 82, color separation image processor 104 and half-tone image processor 106 can be used to process image data, machine settings and printing instructions in ways that cause imagewise modulated surface potentials VEPL at each engine pixel location to be generated so that the desired toner image is formed on the primary imaging member 112.

After writing, primary imaging member 112 has an imagewise modulated surface potential VEPL at each engine pixel location that varies based upon the exposure level at the engine pixel location. In this embodiment, the imagewise modulated surface potential VEPL will be described as being between a greater imagewise modulated surface potential VG and a lesser imagewise modulated surface potential VL. The greater imagewise modulated surface potential can be at the initial surface potential VI reflecting in this embodiment, an image modulated surface potential VEPL at an engine pixel location that has not been exposed, while the lesser image modulated surface potential VL can be at a lesser level reflecting in this embodiment a lower image modulated surface potential VEPL at an engine pixel location that has been exposed by an exposure at an upper range of available exposure settings. For the purposes of this discussion the terms greater, higher, less, and lower are used. As used in this discussion these terms refer to an absolute value of the surface potential and the bias voltage. Likewise the terms increase and decrease will be used in reference to absolute values.

Another meter 134 is optionally provided in this embodiment and measures the surface potential within a non-image test patch area of photoreceptor 114 after the photoreceptor 114 has been exposed to writer 132 to provide feedback related to differences of potential created using writer 132 and photoreceptor 114. Other meters and components (not shown) can be included to monitor and provide feedback regarding the operation of other systems described herein so that appropriate control can be provided.

As is shown in FIGS. 2A-2C, first development system 140 has a first development station 141 with a first toning shell 142 that provides a first developer having a first toner 158 near primary imaging member 112. First toner 158 is charged and has the same polarity as the initial surface potential VI on primary imaging member 112 and as any imagewise modulated surface potential VEPL of the engine pixel locations on primary imaging member 112. In the embodiment of FIGS. 2A-2C, charged first toner 158 is urged to deposit on primary imaging member 112 by a development field that is created by a first net development difference of potential VNET1 between a first bias potential VB1 at first development station 141 and an imagewise modulated surface potential VEPL of the individual engine pixel locations on primary imaging member 112. As stated above, for the purposes of the following discussion the terms greater than and less than will be used. As used in this discussion these terms refer to an absolute value of the surface potential and the bias voltage. Likewise the terms increase and decrease will be used in reference to absolute values. VNET1 will be reduced during development of first toner 158 as the charge of first toner 158 increases the image modulated surface potential VEPL in any engine pixel where the first toner 158 is deposited.

The first net development difference of potential VNET1 varies based on the image modulated surface potential VEPL at each engine pixel location and first bias voltage VB1. In a conventional DAD system, bias voltage VB1 is less than the initial surface potential VI. By subtracting the absolute value of the imagewise modulated surface potential VEPL at an engine pixel location from the absolute value of first bias voltage VB1, a positive value of VNET1 is obtained for the lesser imagewise modulated surface potential VL and a negative value is obtained for the greater imagewise modulated surface potential VG. For positive values of VNET1, the magnitude of the difference of potential VNET1 at an engine pixel location inversely corresponds to the magnitude of image modulated surface potential VEPL at the engine pixel location. The negative value of VNET1 produced at engine pixel locations corresponding to the greater imagewise modulated surface potential VG retards the deposition of first toner 158.

Accordingly, in the embodiment of FIGS. 2A-2C, first toner 158 develops on primary imaging member 112 at engine pixel locations that have an image modulated surface potential VEPL that is at a level that is less than the first bias voltage VB1 and have positive values of VNET1 and does not develop on primary imaging member 112 at locations that have a image modulated surface potential VEPL that is greater than first bias voltage VB1 and have negative values of VNET1.

First development system 140 also has a first supply system 146 for providing the charged first toner 158 to first toning shell 142 and a first power supply 150 for providing the first bias voltage VB1 at first toning shell 142. First supply system 146 can be of any design that maintains or that provides appropriate levels of charged first toner 158 at first toning shell 142 during development. Similarly, first power supply 150 can be of any design that can maintain a first bias voltage VB1 as described herein. In the embodiment illustrated here, first power supply 150 is shown optionally connected to printer controller 82 which can be used to control the operation of first power supply 150.

First toner 158 on first toning shell 142 develops on individual engine pixel locations of primary imaging member 112 in amounts according to the first net development difference of potential VNET1. These amounts can, for example, increase along with increases in first net development difference of potential VNET1 for each individual engine pixel location and such increases can occur monotonically with increases in the first net development difference of potential VNET1. Such development produces a first toner image 25 on primary imaging member 112 having first toner quantities associated with the engine pixel locations that correspond to the magnitude of the first net development difference of potential VNET1.

The electrostatic forces that cause first toner 158 to deposit onto primary imaging member 112 can include Coulombic forces between charged toner particles and the charged electrostatic latent image, and Lorentz forces on the charged toner particles due to the electric field produced by the bias voltages.

In one example embodiment, first development system 140 employs a two-component developer that includes toner particles and magnetic carrier particles. In this embodiment, first development system 140 includes a magnetic core 144 to cause the magnetic carrier particles near first toning shell 142 to form a "magnetic brush," as known in the electrophotographic art. Magnetic core 144 can be stationary or rotating, and can rotate with a speed and direction the same as or different than the speed and direction of first toning shell 142. Magnetic core 144 can be cylindrical or non-cylindrical, and can include a single magnet or a plurality of magnets or magnetic poles disposed around the circumference of magnetic core 144. Alternatively, magnetic core 144 can include an array of solenoids driven to provide a magnetic field of alternating direction. Magnetic core 144 preferably provides a magnetic field of varying magnitude and direction around the outer circumference of first toning shell 142. Further details of magnetic core 144 can be found in U.S. Pat. No. 7,120,379 to Eck et al., issued Oct. 10, 2006, and in U.S. Publication No. 2002/0168200 to Stelter et al., published Nov. 14, 2002, the disclosures of which are incorporated herein by reference. In other embodiments, first development system 140 can also employ a mono-component developer comprising toner, either magnetic or non-magnetic, without separate magnetic carrier particles. In further embodiments, first development system 140 can take other known forms that can perform development in any manner that is consistent with what is described and claimed herein.

As is shown in FIG. 2B, in this embodiment, after a first toner image 25 is formed, rotation of primary imaging member 112 causes first toner image 25 to move past second development system 200 which is not shown as being active in FIGS. 2A-2C, and into a first transfer nip 156 between primary imaging member 112 and a transfer subsystem 50. As shown in FIG. 2B, in this embodiment transfer subsystem 50 has an intermediate transfer member 162 that receives toner image 25 at first transfer nip 156. As is shown in FIG. 2C, intermediate transfer member 162 then rotates to move first toner image 25 to a second transfer nip 166 where a receiver 26 receives first toner image 25. In this embodiment, transfer subsystem 50 includes transfer backup member 160 opposite intermediate transfer member 162 at second transfer nip 166. Receiver transport system 28 passes at least in part through transfer nip 166 to position receiver 26 to receive toner image 25. In this embodiment, intermediate transfer member 162 is shown having an optional compliant transfer surface 164.

The toner image 25 is transferred from primary imaging member 112 to transfer member 162. However, in this embodiment, adhesion forces such as van der Waals forces resist separation of toner image 25 from primary imaging member 112. In the embodiment of FIGS. 2A-2C, a transfer field is created that urges charged first toner 158 forming toner image 25 to overcome the adhesion forces and to transfer onto intermediate transfer member 162. Similarly, a transfer field is also used to assist transfer from the intermediate transfer member 162 onto receiver 26. As is illustrated in the embodiment of FIGS. 2A-2C, a transfer power supply 168 is provided that creates a difference of potential between primary imaging member 112 and intermediate transfer member 162, and a difference of potential between transfer member 162 and transfer backup member 160. These differences in potential create respectively a transfer field to urge toner image 25 onto intermediate transfer member 162 and a transfer field to urge toner image 25 from intermediate transfer member 162 onto receiver 26.

Returning to FIG. 1, it will be understood that in one mode of operation printer controller 82 causes one or more of individual printing modules 40, 42, 44, 46 and 48 to generate a toner image 25 of a single color of toner for transfer by respective transfer subsystems 50 to receiver 26 in registration to form a composite toner image 27.

Second Development System

Figure 3A:
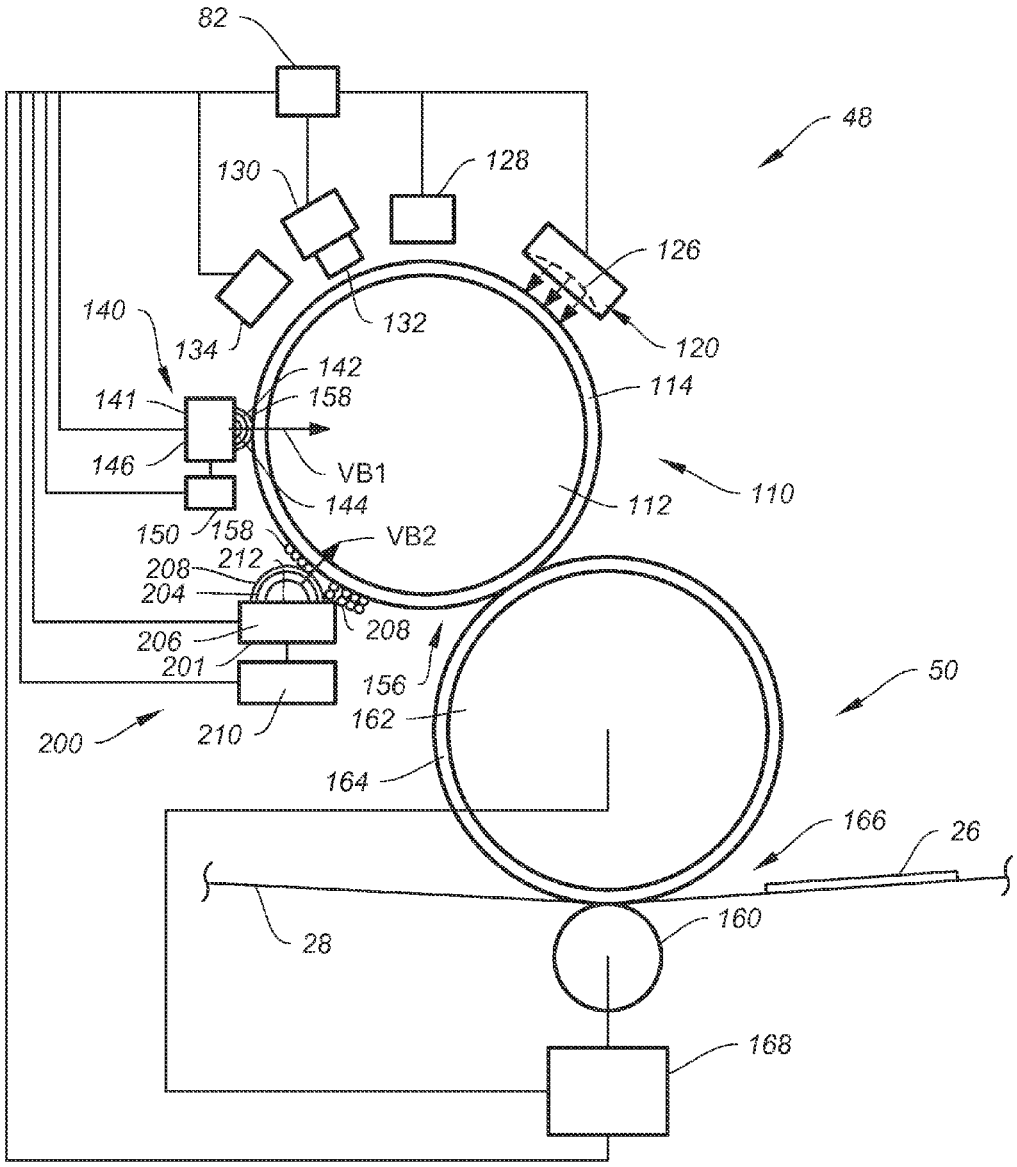
FIGS. 3A-3C illustrates the embodiment of printing module of FIGS. 2A-2C, with a second development system in use.
Figure 3B:
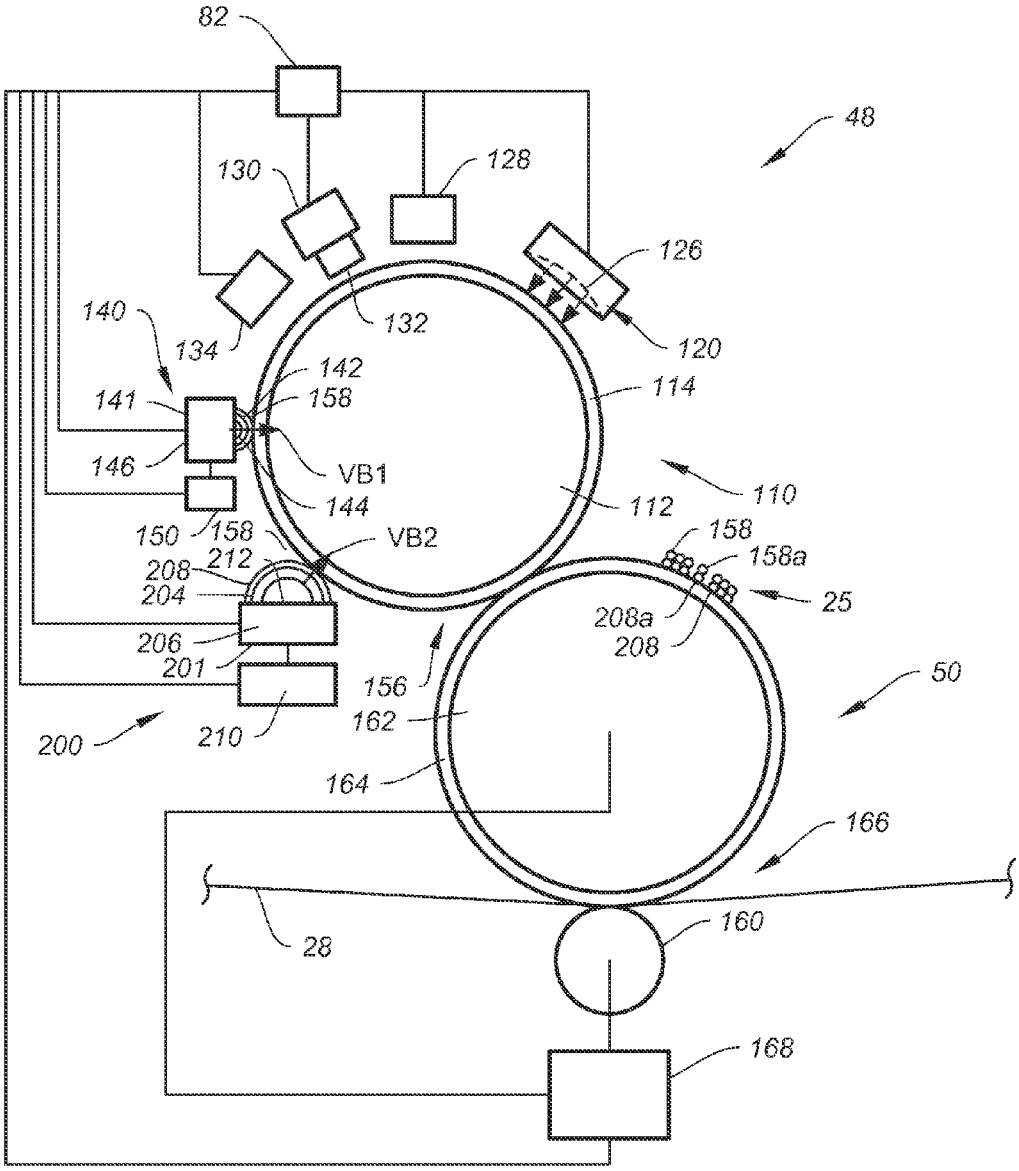
Figure 3C:
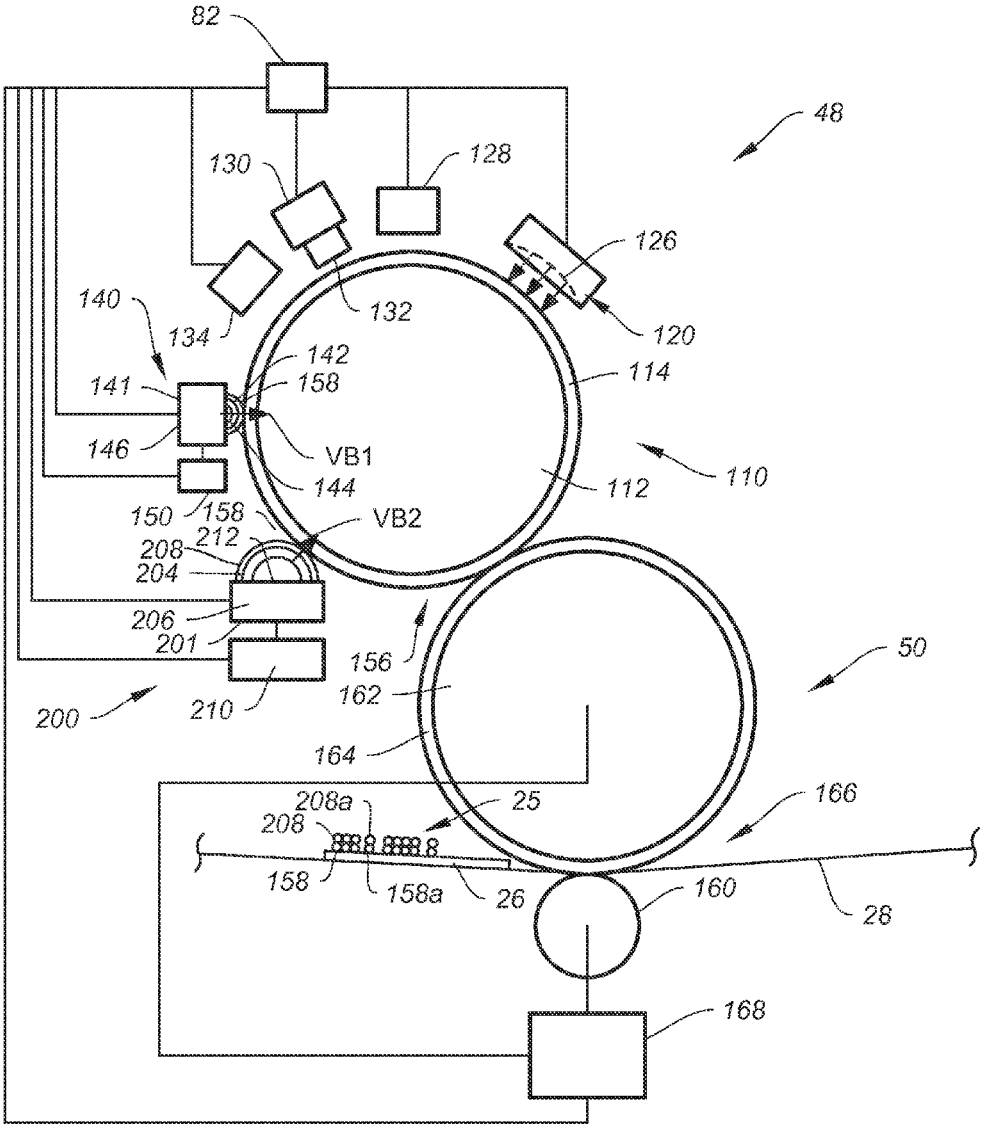

FIGS. 3A-3C illustrate the embodiment of printing module 48 shown in FIGS. 2A-2C, with a second development system 200 used to allow a further development of the electrostatic latent image formed on a primary imaging member 112 after first development. As is shown in FIG. 3A, second development system 200 can be incorporated into any of printing modules 40-48 and optionally can be selectively activated by way of signals from printer controller 82.

In this embodiment, second development system 200 has a second development station 201 with a second toning shell 204 and a magnetic core 212 which may rotate that provides a second developer having a second toner 208 near primary imaging member 112. Second toner 208 is charged and has a charge of the same polarity as first toner 158, the initial surface potential VI on primary imaging member 112 and any image modulated surface potential VEPL of the engine pixel locations. Second development station 201 also has a second toner supply system 206 for providing charged second toner 208 of the first polarity to second toning shell 204 and a second power supply 210 that provides a second bias voltage VB2 at second toning shell 202. Second toner supply system 206 can be of any design that maintains or that provides appropriate levels of charged second toner 208 at a second toning shell 204 during development. Similarly, second power supply 210 can be of any design that can maintain second bias voltage VB2 on second toning shell 204 as described herein. In the embodiment illustrated here, second power supply 210 is shown optionally connected to printer controller 82 which can be used to control operation of second power supply 210.

In general, printing modules 40-48 having such a second development system 200 can be operated as described above to create a first toner image 25 on photoreceptor 114 of primary imaging member 112 as is shown in FIG. 3A.

As is also shown in FIG. 3A, when second bias voltage VB2 is supplied to second toning shell 204 a second net development difference of potential VNET2 arises between second bias voltage VB2 and the imagewise modulated surface potential VEPL at individual engine pixel locations on primary imaging member 112 modified by the charge of any first toner 158 developed at the engine pixel location. The second net development difference of potential VNET2 at an engine pixel location is the second bias voltage VB2 less any image modulated surface potential VEPL at the engine pixel location and less any surface potential arising from the presence of any first toner 158 at the engine pixel location.

Second toner 208 from second toning shell 204 deposits on individual engine pixel locations on primary imaging member 112 in an amount according to the second net development difference of potential VNET2. This amount can, for example, reflect the value of the second development difference of potential VNET2 and for positive values of VNET2 monotonically increases as a function of magnitude of the second net development difference of potential VNET2.

The electrostatic forces that cause second toner 208 to deposit onto primary imaging member 112 can include Coulombic forces between charged toner particles and the charged electrostatic latent image, and Lorentz forces on the charged toner particles due to the electric field produced between the bias voltage supplied to the second toning shell 204 and the surface potential at the engine pixel location modified by the charge of any first toner 158 developed at the engine pixel location. Second development station 201 can optionally employ a two-component developer or a one component developer and a magnetic core as described generally above with reference to first development station 141.

First development system 140 can be subject to development efficiency limitations. Theoretically, development of a charge pattern continues until VNET1 equals zero. However, it will be appreciated that under certain conditions, an amount of toner developed at an engine pixel location during development may be less than what is required to drive first net development difference of potential VNET1 to zero. The extent to which development of first toner 158 drives VNET1 to zero is known as development efficiency. A number of factors can influence development efficiency including charging conditions, toner concentration, toner delivery rate, development exposure times, environmental conditions and the like.

When there is a development efficiency of less than 100 percent at an engine pixel location and second development system 200 is active, a portion of the unused first net development difference of potential can be used to urge second toner 208 to develop at the engine pixel location. The amount of second toner 208 deposited at an engine pixel location therefore varies based upon the amount of first toner 158 at the engine pixel location.

Where the second bias potential VB2 is generally equal to the first bias voltage VB1, development of second toner 208 will continue until the second net development difference of potential VNET2 reaches or approaches a point where the second net development difference of potential VNET2 is zero. Because first development potential VB1 is equal to second bias voltage VB2 the second toner completes the development left uncompleted by the first toner.

Optionally, second bias potential VB2 can be greater than first bias potential VB1 and can also be greater that initial surface potential VI. When VB2 is greater than VI, a minimum controlled amount of second toner 208 is selectively applied to each of the engine pixel locations. This can be done to provide, for example, a coating of second toner for the image.

Second toner 208 is different than first toner 158. The difference can take many forms. In one embodiment first toner 158 can have first color characteristics while the second toner 208 has different second color characteristics. In one example of this type, first toner 158 can be a toner of a first color having a first hue and second toner 208 can be a toner having the first color and a second different hue.

First toner 158 and second toner 208 can have different material properties. For example, in one embodiment first toner 158 can have a first viscosity and the second toner 208 can have a second viscosity that is different from the first viscosity. In another embodiment, first toner 158 can have a different glass transition temperature than second toner 208. In one example of this type, the second toner 208 can have a lower glass transition temperature than first toner 158. In certain embodiments, second toner 208 can take the form of a toner that is clear, transparent or semi-transparent when fused. In other embodiments, second toner 208 can have finite transmission densities when fused.

First toner 158 and second toner 208 can be differently sized. For example, and without limitation, first toner 158 can comprise toner particles of a size between 4 microns and 9 microns while the second toner 208 can have toner particles of a size between 10 microns and 20 microns or more. First toner 158 and second toner 208 can also have other different properties such as different shapes, can be formed using different processes, or can be provided with additional additives, coatings or other materials known in the art that influence the development, transfer or fusing of toner.

As is shown in FIG. 3B, in this embodiment, after a first toner image 25 having first toner 158 and second toner 208 is formed, rotation of primary imaging member 112 causes first toner image 25 to move into the first transfer nip 156 between primary imaging member 112 and a transfer subsystem 50. As is shown in FIG. 3C, intermediate transfer member 162 then rotates to move first toner image 25 to a second transfer nip 166 where a receiver 26 receives first toner image 25.

In general a printer 20 having a printing module such as module 48 having a second development station 201 can be used to provide, a combination of a first toner 158 and a second toner 208 of a different type at an engine pixel location in a manner that automatically inversely adapts to an amount of first toner 158 on which the second toner 208 is applied and that automatically and precisely registers second toner 208 with first toner 158. This eliminates the risk that a first toner 158 to be applied at an engine pixel location will not be combined with a second toner 208 to be applied at the engine pixel location as a result of variations in the toner image as formed or as a result of misregistration during transfer.

Figure 4:
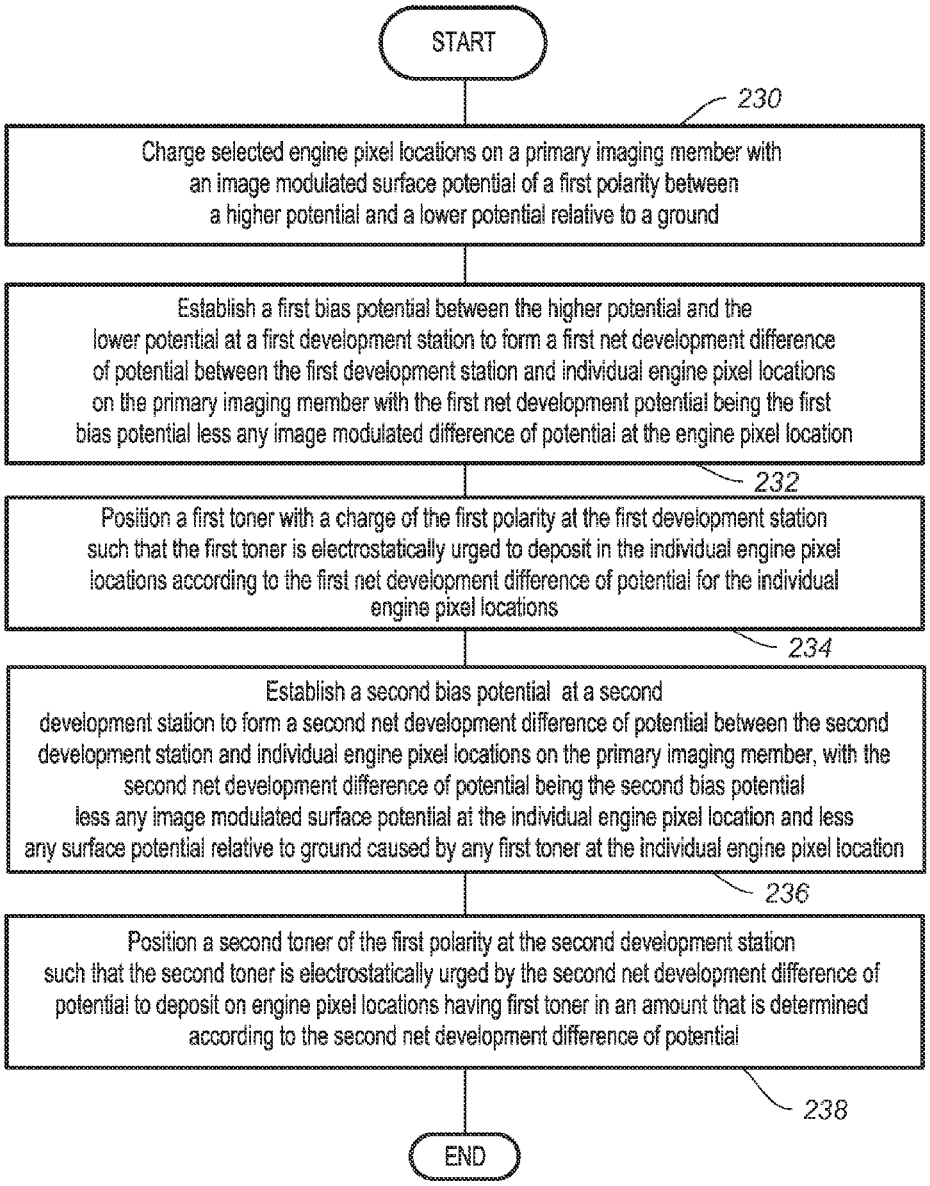
FIG. 4 shows a first embodiment of a method for operating a printer.

FIG. 4 shows a first embodiment of a method for operating a printer. In a first step of this method, an imagewise modulated surface potential VEPL is created at each engine pixel location of a primary imaging member such that the imagewise modulated surface potential VEPL at each engine pixel location is between a lesser surface potential VL and a greater surface potential VG (step 230). This can be done, for example, as described above in the printing module 48 of FIGS. 2A-2C, and 3A-3C using charging subsystem 120 to generally uniformly charge photoreceptor to an initial surface potential VI and writing system 130 to expose a photoreceptor 114 to selectively release charge on photoreceptor 114. In other embodiments, this step can also be performed using any other charging-writing system that is compatible with a discharge area development process.

A first bias voltage VB1 is established at first toning shell 142 using, in this example, first power supply 150. The first bias voltage VB1 is provided in a range between the higher surface potential VG and the lesser surface potential VL. This creates a first net development difference of potential VNET1 defined by the difference between the first bias voltage VB1 at first toning shell 142 and the image modulated surface potential VEPL at an individual one of the engine pixel locations on primary imaging member 112. The first net development difference of potential VNET1 for an engine pixel location is the first bias voltage VB1 less any image modulated surface potential VEPL at the engine pixel location (step 232).

Particles of first toner 158 having the first polarity are positioned between first toning shell 142 and the engine pixel locations so that the first net development difference potential VNET1 electrostatically urges first toner 158 to deposit at individual engine pixel locations according to the first net development potential VNET1 for the individual picture element locations (step 234).

A second bias voltage VB2 of the first polarity is established at second toning shell 204 using for example, second power supply 210. This creates a second net development difference of potential VNET2 between the second toning shell 204 and the individual engine pixel locations on primary imaging member 112. The second net development difference of potential VNET2 for the individual image pixel locations is the second bias voltage VB2 less the image modulated surface potential VEPL at the individual engine pixel location. If VB2 equals VB1 the second net development difference of potential VNET2 is less than VNET1 at engine pixel locations where first toner 158 has been developed in amounts that can range, for example, and without limitation, between about 25 and 50 percent of VNET1 (step 236).

When second bias voltage VB2 is supplied to second toning shell 204 a second net development difference of potential VNET2 arises between second bias voltage VB2 and the image modulated surface potential VEPL at individual engine pixel locations on primary imaging member 112 modified by the charge of any first toner 158 developed at the engine pixel location. The second net development difference of potential VNET2 at an engine pixel location is the second bias voltage VB2 less any image modulated surface potential VEPL at the engine pixel location and less any surface potential arising from any first toner 158 or second toner 208 at the engine pixel location.

Second toner 208 having the first polarity is positioned so that the field created by second net development potential VNET2 electrostatically urges second toner 208 to deposit on the engine pixel locations to form a second toner image 25 having second toner 208 at each picture element location in amounts that are modulated by the second net development potential VNET2 (step 238).

When second toner 208 is presented, the second bias voltage VB2 may be generally equal to the first bias voltage VB1 and less than an initial surface potential VI on the primary imaging member 112. This causes an amount of second toner 208 to deposit on individual engine pixel locations having the first toner 158 according to the second net difference of potential VNET2 between second bias voltage VB2, the potential provided by the charge of any first toner 158 at an individual engine pixel location and the image modulated potential VEPL at the individual engine pixel locations. For positive values of VNET2, when second net development difference of potential VNET2 increases the amount of second toner 208 increases.

However, since second bias voltage VB2 is not greater than initial surface potential VI and generally equal to VB1, no second toner 208 deposits on portions of primary imaging member 112 that are unexposed during writing and that therefore have the initial surface potential VI. Thus, using the method and the bias levels of FIG. 4, second toner 208 generally develops at an individual engine pixel location to the extent that first toner 158 does not.

Figure 5A:
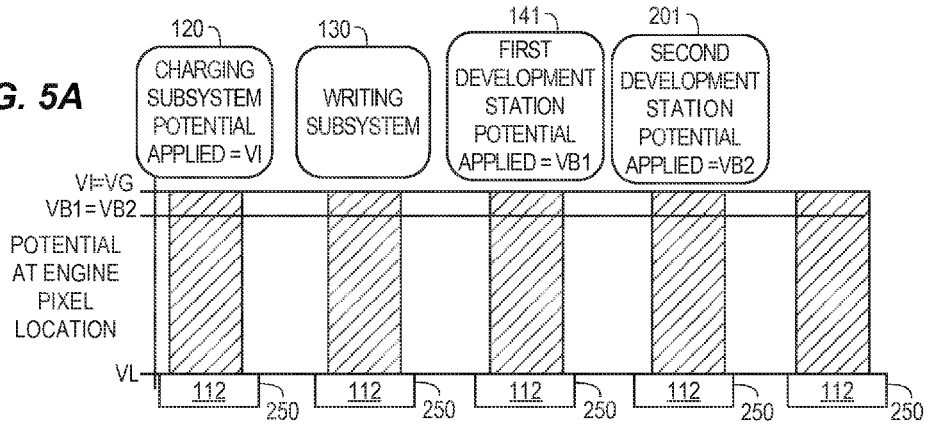
FIGS. 5A-5C illustrate development of toner at engine pixel locations having different imagewise modulated surface potentials according to one embodiment.
Figure 5B:
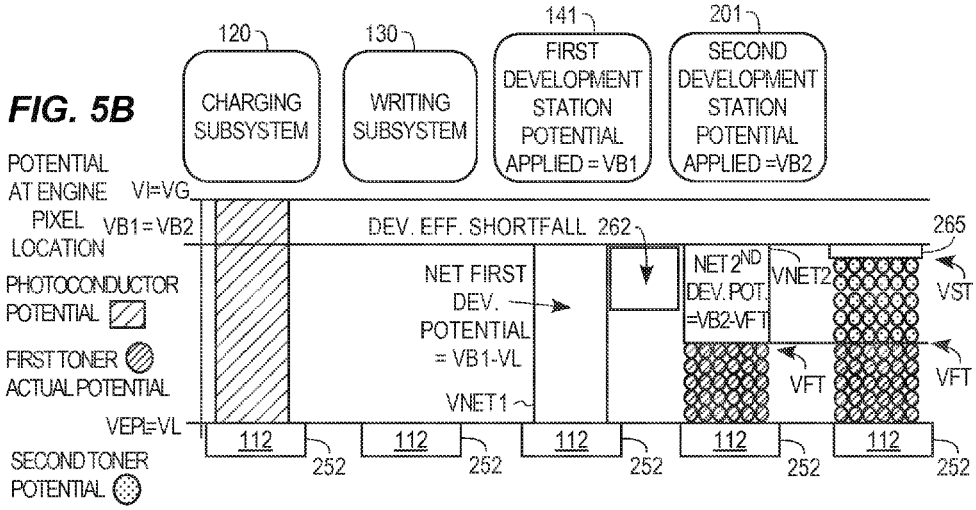
Figure 5C:
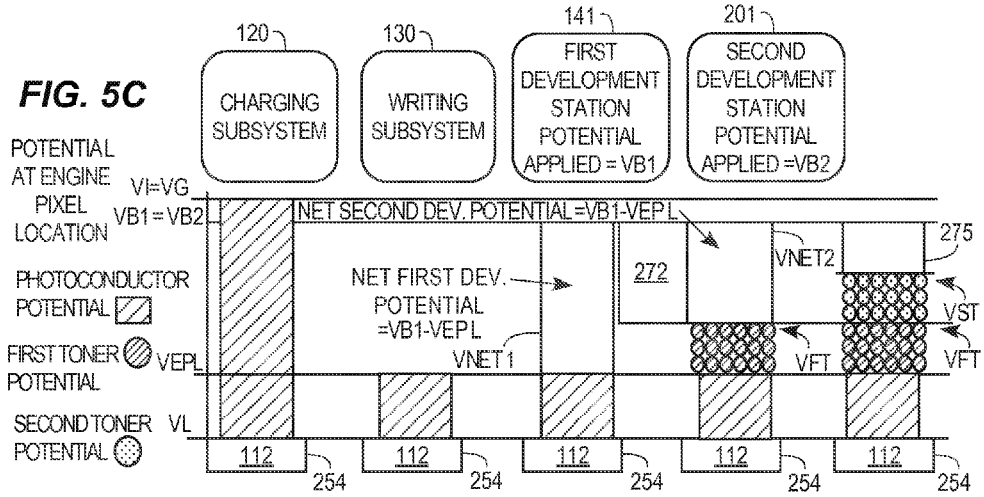

FIGS. 5A-5C provide illustrations depicting the operation of the method of FIG. 4 at different engine pixel locations that have different imagewise modulated surface potential relative to ground VEPL when the method of FIG. 4 is used to provide a toner overcoat on toned portions of a receiver.

FIG. 5A shows an engine pixel location 250 on primary imaging member 112 that is charged to an initial surface potential VI. When engine pixel location 250 is moved through writing system 130 no exposure is made. This can occur, for example, where the image data for an image to be printed does not require any first toner 158 to be recorded at engine pixel location 250. Accordingly, the image modulated potential VEPL at engine pixel location 250 remains at the initial surface potential VI. Because in this example, first bias voltage VB1 is not greater than initial surface potential VI, the net first development difference of potential VNET1 between first development system 140 and engine pixel location 250 as engine pixel location 250 passes proximate to first development station 141 is negative. Accordingly, there is no development of first toner 158 to engine pixel location 250. Similarly, because in this example, the second bias voltage VB2 is generally equal to VB1 and less than VI, the second net development difference potential VNET2 as engine pixel location 250 is passed through second development system 200 is negative. Accordingly, there is no development of second toner 208 to engine pixel location 250 and engine pixel location 250 remains untoned.

FIG. 5B illustrates the operation of the method of FIG. 4 at another engine pixel location 252 that is highly exposed during writing. In this example, first bias voltage VB1 and second bias voltage VB2 are not greater than the initial surface potential VI and are generally equal. Both first bias voltage VB1 and second bias voltage VB2 are greater than the image modulated surface potential VEPL of engine pixel location 252 which at engine pixel location 252 is at the lesser image modulated surface potential VL.

When primary imaging member 112 is moved past first development station 141, first toner 158 deposits at engine pixel location 252 in an amount that is determined by the first net development difference of potential VNET1 between first bias voltage VB1 and an imagewise modulated surface potential VEPL at engine pixel location 252. The surface potential at engine pixel location 252 changes because of the deposition of first toner 158 and the surface potential after development of first toner 158, the first toner modulated surface potential VFT, is the imagewise modulated surface potential at engine pixel location 252 that has been modified by the charge associated with the deposited first toner 158. In theory, first toner 158 would deposit at engine pixel location 252 until VFT equals VB1, but a development shortfall 262 arises due to a development efficiency that is less than unity.

As is further shown in FIG. 5B, when engine pixel location 252 reaches second development station 201, a second bias voltage VB2 on a second toning shell 204 is applied and an amount of second toner 208 is developed at engine pixel location 252 that is determined by a second net development difference of potential VNET2. The charge associated with the amount of second toner 208 deposited at engine pixel location 252 changes the surface potential at engine pixel location 252 to second toner modulated surface potential VFT. The amount of second toner 208 can also be subject to a second development shortfall 265 where the development efficiency of the second development station 201 is less than unity.

In this embodiment, second bias voltage VB2 is set at a level that is generally equal to first bias voltage VB1 and not greater than initial surface potential VI. Accordingly, the amount of second toner 208 that deposits on an individual engine pixel location 252 during second development is modulated by the first toner modulated surface potential VFT that includes the charge associated with first toner 158 that is at engine pixel location 252. The second toner 208 is applied to each of the engine pixel locations in an amount that is modulated, at least in part based on first toner modulated surface potential VFT caused by a first toner 158 at the engine pixel location. This result is achieved without requiring the use of a separate printing module and the attendant need to generate an image to be printed by the separate printing module to apply second toner 208 in an imagewise fashion.

FIG. 5C illustrates the operation of the method of FIG. 4 at another engine pixel location 254 that is partially exposed during writing. In this example, first bias voltage VB1 and second bias voltage VB2 are likewise generally equal and not greater than initial surface potential VI. Both first bias voltage VB1 and second bias voltage VB2 are greater than the image modulated surface potential VEPL of engine pixel location 254 which is set at a potential between the greater imagewise modulated surface potential VG and the lesser imagewise modulated surface potential VL.

When primary imaging member 112 is moved past first development station 141, first toner 158 deposits at engine pixel location 254 until the first toner 158 at engine pixel location 254 produces a first toner modulated surface potential VFT that is generally the same as first bias voltage VB1 less a development shortfall 272 that arises due to development efficiency being less than 100 percent.

As is further shown in FIG. 5C, when engine pixel location 254 reaches second development station 201, second bias voltage VB2 is established to provide a second net development difference of potential VNET2 which is calculated by subtracting the absolute value of first toner modulated surface potential VFT at engine pixel location 254 from the absolute value of second toning bias VB2. Second toner 208 is developed at engine pixel location 254 and the actual amount of second toner 208 developed at engine pixel location 254 can also be subject to a second development shortfall 275.

In this embodiment, second bias voltage VB2 is set at a level that is generally equal to first bias voltage VB1 but not greater than initial surface potential VI. Accordingly as has been illustrated in FIGS. 5A-5C, no second toner 208 is applied at engine pixel locations that remain at the initial surface potential VI. The amount of second toner 208 that deposits on individual engine pixel locations 252 and 254 during second development is modulated by the charge of the first toner 158 that is at engine pixel location 254 and by any image modulated surface potential VEPL at engine pixel location 254. This result is achieved without requiring the use of a separate printing module and the attendant need to generate an image to be printed by the separate printing module to apply second toner 208 in an imagewise fashion.

Figure 6A:
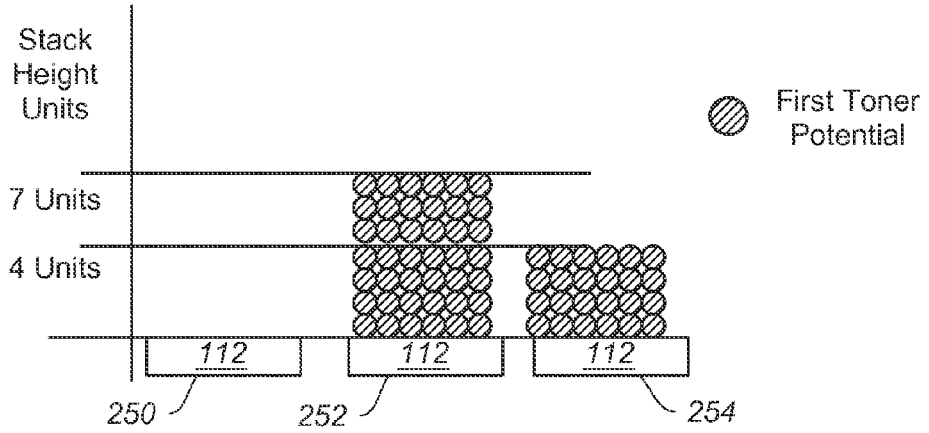
FIGS. 6A and 6B illustrate toner amounts formed at engine pixel locations.
Figure 6B:
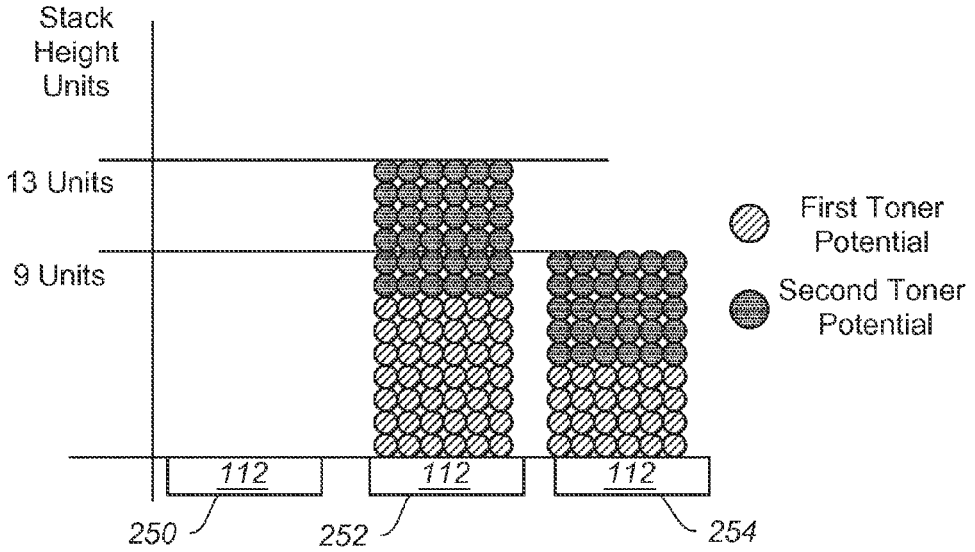

FIGS. 6A and 6B conceptually illustrate amounts of first toner 158 that are developed at engine pixel locations 250, 252 and 254 presuming for the purposes of this discussion that first toner 158 and second toner 208 are developed in amounts that are proportional to the net first development difference of potential VNET1 and the second net difference of potential VNET2 as is discussed with reference to FIGS. 5A, 5B and 5C. Such presumptions are not critical but are used here to simplify this discussion. It will be appreciated that in other embodiments where first toner 158 or second toner 208 can develop as a function of first net development difference of potential VNET1 and second net development difference of potential VNET2 in amounts that are not relatively proportional. Compensation for such different contributions to the amount of first toner 158 and second toner 208 provided in response to the same net development difference of potential can be achieved through adjustments of the first bias voltage VB1, second bias voltage VB2, the image modulated potential at each engine pixel location VEPL, or the magnitude of the charge on first toner 158 or the second toner 208.

Similarly, for the purposes of FIGS. 6A and 6B it is assumed without limitation that first toner 158 and second toner 208 contribute to the toner stack height at a location on receiver 26 in a manner that is roughly equivalent for an equivalent amount of first toner 158 and second toner 208 thereon. However, here too this assumption is not critical and first toner 158 and second toner 208 can contribute to toner stack height at a location on receiver 26 in a different manner for an equivalent amount of first toner 158 and second toner 208 thereon. Here again compensation for such different manner of development can be made by adjustment of the first bias voltage, second bias voltage VB2, the potential at each engine pixel location VEPL, or the magnitude of the charge on particles of first toner 158 or the second toner particles.

As is shown in FIG. 6A, after development, engine pixel location 250 has no units of first toner 158 developed thereon. This yields a first toner stack height that is zero at engine pixel location 250 on primary imaging member 112. As is also shown in FIG. 6A, engine pixel location 252 has an amount of first toner 158 that creates seven units of stack height of first toner 158 and engine pixel location 254 has an amount of first toner 158 thereon to form a toner stack height of 4 units. Accordingly, in this case, a toner image that includes toner from engine pixel locations, 250, 252 and 256 provides a range of toner stack heights of at least 7 units of stack height in a first toner image 25 in this manner.

However, as is shown in FIG. 6B, when second toner 208 is applied in the manner described above with reference to FIGS. 5B and 5C, the toner stack height at engine pixel location 252 is 13 units, while the toner stack height at engine pixel location 254 is now 9 units; this yields a relief differential of 4/9 or about 44%. It will also be appreciated that such relief improvements can be further increased where it is possible to provide a separation in potential between first bias voltage VB1 and second bias voltage VB2 without developing second toner 208 in unexposed engine pixel locations. If large negative values of VNET1 can be tolerated, it would be possible to set VB2 greater than VB1 but still less than VI and maintain negative values of VNET2 sufficient to prevent deposition of second toner 208 at engine pixel locations having an imagewise modulated surface potential of VG.

It will be appreciated from this that in this example of a printing module having a writing system 130 that writes according to a DAD model and that has the first development system 140 and second development system 200 as disclosed herein and that provides an initial surface potential of VI that is generally greater than first bias voltage VB1 and a second bias voltage VB2, second toner 208 will not be attracted to engine pixel locations such as engine pixel location 250 of FIG. 5A on the photoreceptor 114 that are not exposed during the writing of the latent image as these engine pixel locations will remain at the initial surface potential VI and resist any toner transfer of the second toner 208 as long as a sufficient negative value of VNET2 is maintained to prevent deposition of the second toner 208. Further, second toner 208 is only transferred to engine pixel locations to which a full density amount of first toner 158 is transferred to the extent that is defined by the difference between second bias voltage VB2 and first bias voltage VB1.

In this way, second toner 208 can be used to provide an uppermost layer of any engine pixel location having first toner 158 developed thereon. These layers can then be transferred to a receiver 26 using transfer subsystem 50 and fused.

This can provide a toner image with controlled surface properties such as improved wear resistance, consistent gloss, and protection against ultraviolet radiation, chemical contamination and the like.

Further, precise registration of the second toner 208 with the first toner 158 at individual engine pixel location becomes possible without requiring imagewise placement of the second toner 208 because the electrostatic forces that urge transfer of an amount of the second toner 208 to an engine pixel location such as engine pixel locations 250, 252 or 254 automatically develop desired amounts of second toner 208 at these engine pixel locations as a function of the same difference of potential at the engine pixel location VEPL used to develop the first toner and as a function of first toner actually located on the primary imaging member 112.

As is also shown in the example of FIGS. 5A-5C and 6A-6B, toner stack height variations caused by development efficiency limitations are compensated for by the additional toner stack height added by second toner 208. Importantly, this compensation is made at each pixel location without using the printing modules 40-48 in a print engine 22 to deliver image forming toner and without requiring that a printer controller 82 perform color separation processing, then calculate toner stack heights, and then assemble a toner image.

In certain embodiments, it can be useful for a printer 20 to generate prints 70 that have, effectively, an overcoat of second toner 208 even in portions of receiver 26 that do not have first toner 158 developed thereon. This can be done, for example, where receiver 26 has a post fused gloss that is not consistent with the post fused gloss of a second toner 208. In such a case or for other reasons, adjustment of the second bias voltage VB2 above the initial surface potential VI allows coverage of the receiver 26 with second toner 208.

Figure 7A:
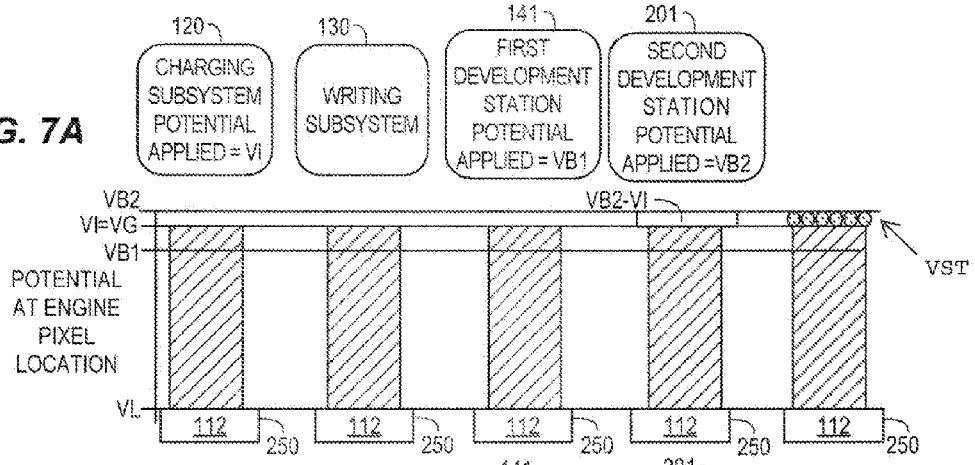
FIGS. 7A-7C illustrate development of toner at engine pixel locations having different imagewise modulated surface potentials according to another embodiment.
Figure 7B:
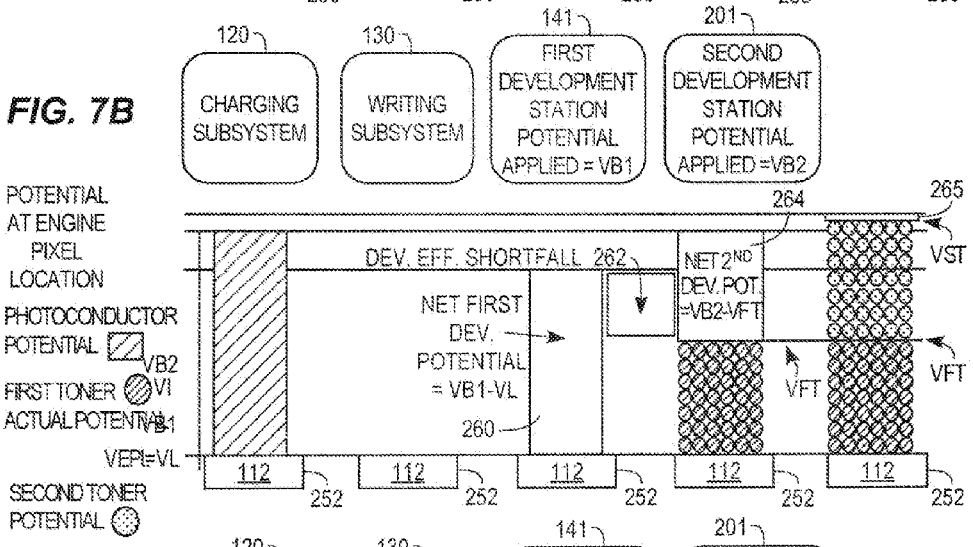
Figure 7C:
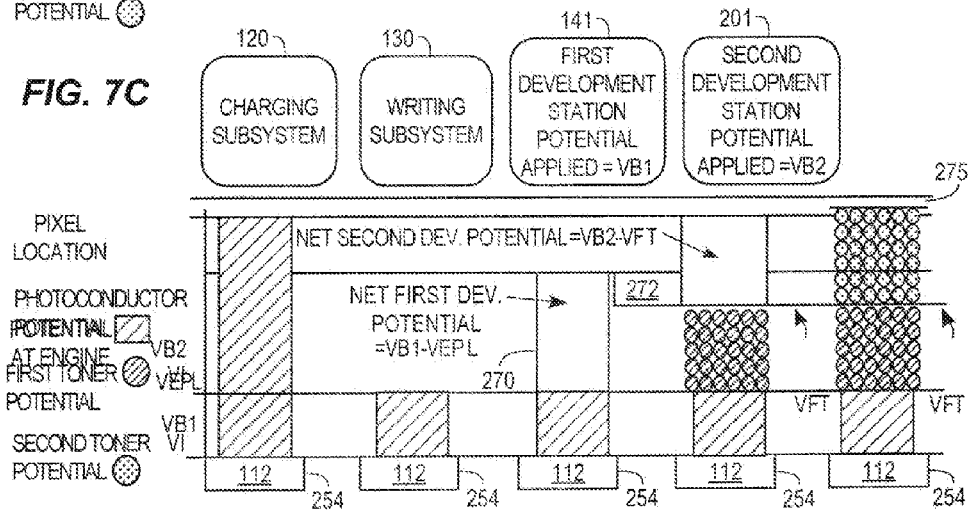

This is illustrated in FIGS. 7A-7C, in which it is shown that by providing a second development bias VB2 greater than initial surface potential VI and first bias voltage VB1, it becomes possible to deposit second toner 208 on engine pixel locations having first toner 158 as is generally described above and also to provide second toner 208 on untoned portions of receiver 26 that do not have first toner 158 such that there is a second toner of at least a thickness that is determined by the difference of potential between the second bias voltage VB2 and the initial surface potential VI.

As can be seen from FIG. 7A, where engine pixel location 250 is charged to an initial surface potential VI and is not discharged, and no first toner 158 will develop to engine pixel location 250. However, because second bias voltage VB2 is greater than initial surface potential VI an amount of second toner 208 will develop at engine pixel location 250 because there is a net difference in potential between the initial surface potential VI and the second bias voltage VB2. The amount of second toner 208 deposited at a fully exposed engine pixel location 252 and a partially exposed engine pixel location 254 are similar to those described above with respect to FIGS. 5B and 5C respectively, however, with an additional amount of second toner 208 provided according to the difference in potential between the second bias voltage VB2 and the initial surface potential VI.

As has been discussed elsewhere herein the second bias voltage VB2 exceeds the first bias voltage VB1. In one embodiment second bias voltage VB2 exceeds the first bias voltage VB1 by at least about 25 percent. This advantageously creates a relatively thick layer of second toner 208, and further allows additional second net development difference of potential VNET2 during the development of second toner 208 to enable higher efficiency development at least during a portion of the second development.

In the embodiments described above, second toner 208 has been described as being applied onto one or more first toners 158. First toner 158 is referred to in various places as a color toner, or has been described as providing differently colored toners or that form images according to color separation images. This has been done for convenience only and is not limiting. A first toner 158 can be applied according to any type of image or pattern and the color of the first toner 158 is not critical. Without limitation, a first toner 158 can be applied according to any first toner pattern such as a pattern that defines a structure that is to be formed on receiver 26 or an arrangement of toners that are of a type or that are applied in patterns that are intended to achieve functional outcomes such as forming structures, optical elements, electrical circuit components or circuits or desirable arrangements of biological material or components thereof.

Development of Inter-Area Fields

Figure 8:
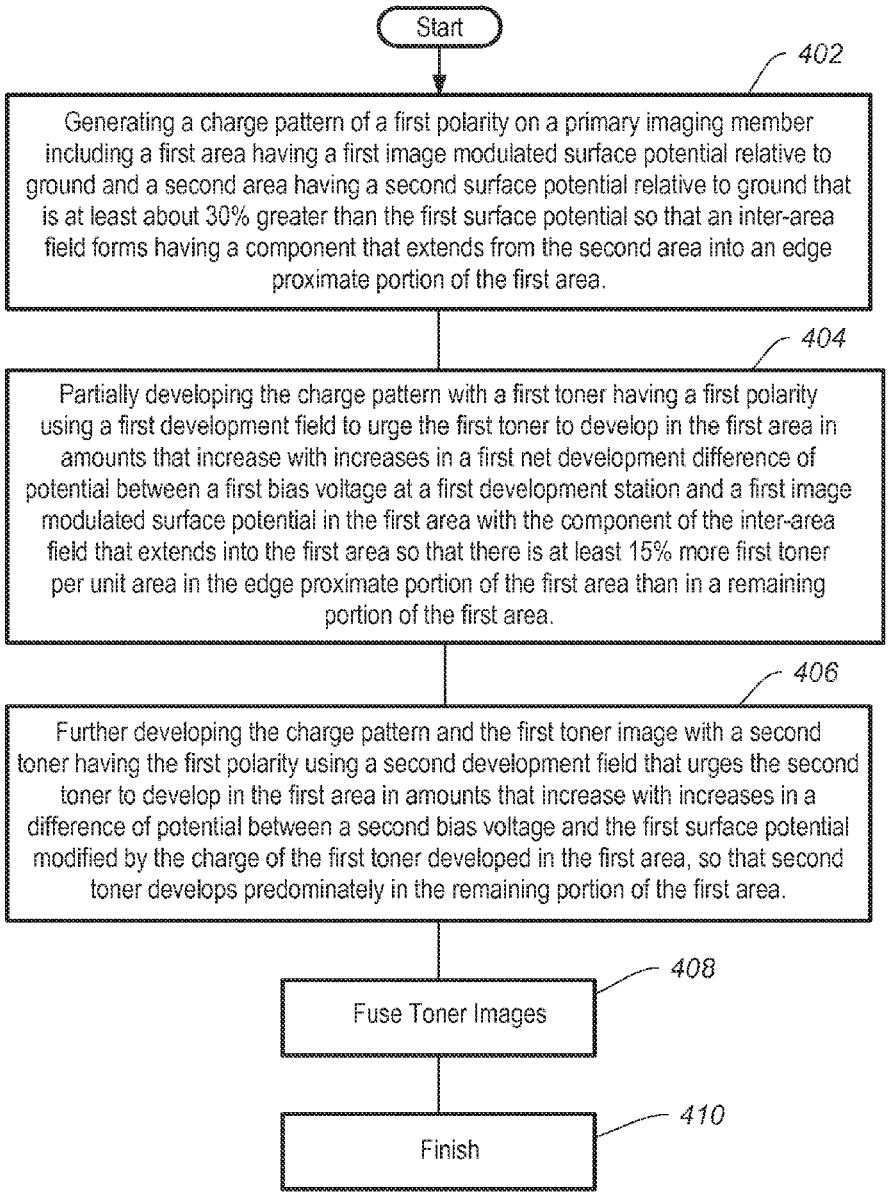
FIG. 8 illustrates another embodiment of a method for operating a toner printer.

FIG. 8 illustrates another embodiment of a method for operating a toner printer such as toner printer 20 having a second toner development system 200. As shown in the embodiment of FIG. 8, a charge pattern is generated on a primary imaging member 112 (step 402). The methods used to generate the charge pattern are generally consistent with those that are described above with printer controller 82 determining a charge pattern to be created based upon print order data. Printer controller 82 provides writing system 130 with instructions that cause writing system 130 to expose primary imaging member 112 to light such that the charge pattern is formed on primary imaging member 112. In other embodiments other methods for forming a charge on primary imaging member 112 can be used. However, here the charge pattern includes first area having a first potential relative to ground and a second area having a second potential relative to ground that is at least about 30% greater than the first potential. An inter-area field forms with a component that extends across an edge between the first area and the second area into an edge proximate portion of the first area.

Figure 9A:
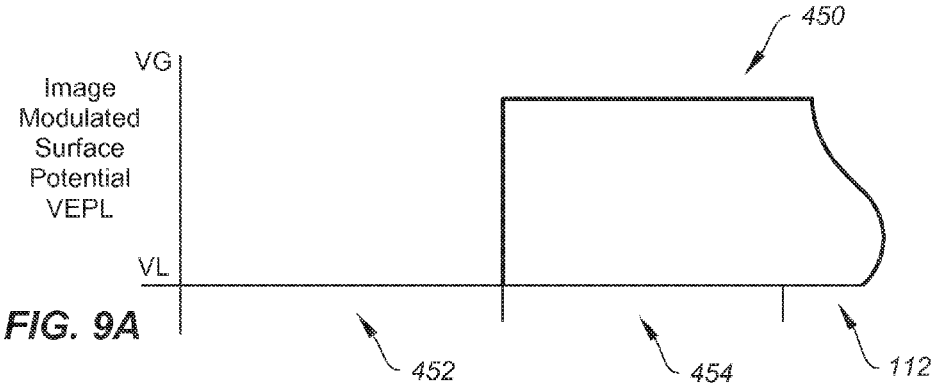
FIGS. 9A-9D illustrates the effects of the presence of multiple fields on the development of a first toner in an engine pixel location.

FIG. 9A shows one example of a portion of such a charge pattern 450 on a primary imaging member 112. As shown in FIG. 9A in this example, first area 452 takes the form of a first engine pixel location that has a first imagewise modulated surface potential VEPL(452) that is at a lower voltage level of VL and an second area 454 takes the form of a second engine pixel location that has a first image modulated surface potential VEPL(454) that is at a higher voltage level of VG.

Figure 9B:
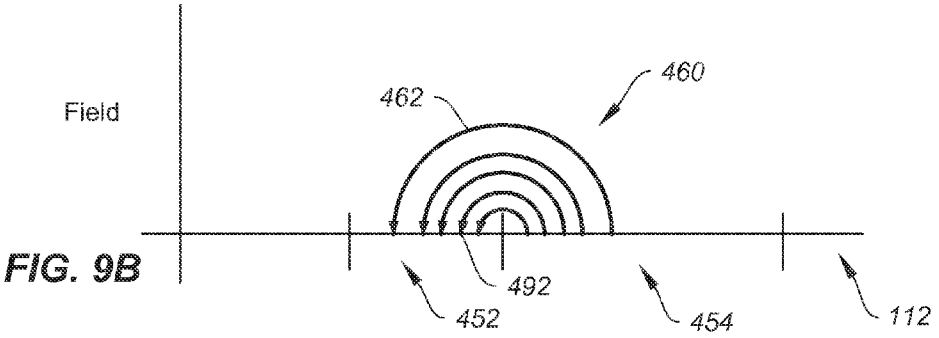

As is shown conceptually in FIG. 9B, an inter-area field 460 exists between imagewise modulated surface potential VEPL(454) VG and imagewise modulated surface potential VEPL(452) VL and extends across the edge between second area 454 and first area 452. This is illustrated by the field lines 462 in FIG. 9B. As is illustrated in FIG. 9B, field lines 462 extend into an edge proximate portion 492 of first area 452.

Figure 9C:
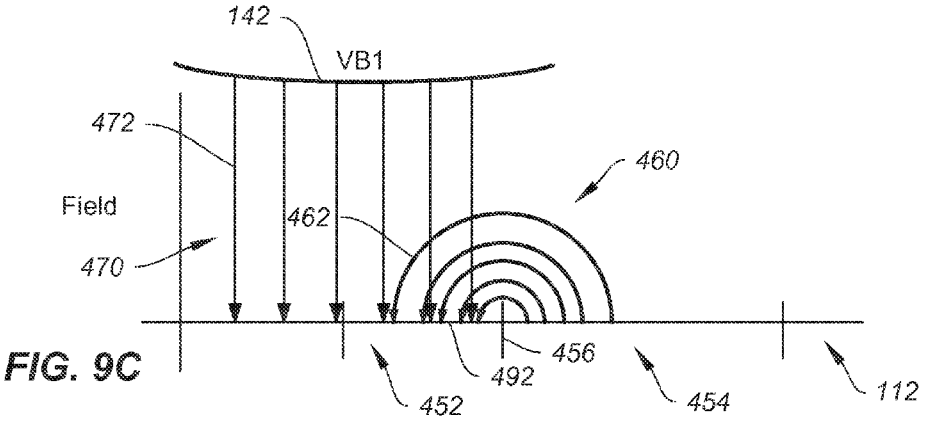

Accordingly, as is shown in FIG. 9C, when a first toning shell 142 having a first bias voltage VB1 is positioned proximate to first area 452, a first development field 470 represented by field lines 472 is created. In this example the first bias voltage is the same as the higher potential VG and the first development field 470 has a field strength that is determined by the difference between first bias voltage VB1 on first toning shell 142 and the image modulated surface potential VEPL(452). First development field 470 generally illustrated by field lines 472 is generally uniform across first area 452 and provides a field strength having force that provides a relatively uniform force to urge particles (not shown) of first toner 158 to develop in first area 452 generally uniformly.

However, as is also illustrated in FIG. 9C, inter-area field 460 extends into edge proximate portion 492 of first area 452. Inter-area field 460 represented by field lines 462 provides additional field that also urges development of first toner 158. As is shown conceptually by the difference in separation in field lines 462, the field strength of inter-area field 460 is strongest closer to edge 456 and the influence of inter-area field 460 diminishes according to a gradient at points that are further from edge 456. Accordingly, development of first toner 158 in first area 452 occurs as a function of total development field that is strongest proximate to edge 456 and that progressively weakens as a distance from edge 456 increases.

It will be appreciated from this that in the early stages of development of a first toner 158 in first area 452 using a DAD model first toner 158 develops predominantly in edge proximate portion 492 where the development is influenced both by the development field 470 and the inter-area field 460.

Figure 9D:
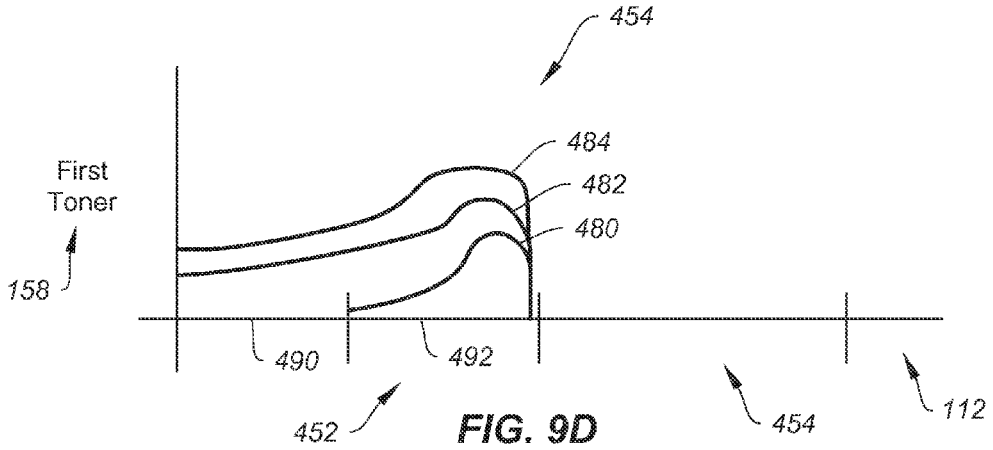

FIG. 9D shows one example of the impact of the field gradient during the partial development of first toner 158. During a first stage of development, the field gradient can cause first toner 158 to be located almost exclusively in an edge proximate portion 492 of first area 452 with little or no development of first toner 158 in remaining portion 490 of first area 452. First toner image 480 in FIG. 9D is an example of a first toner image that can arise in first area 452 if partial development of charge pattern 450 is ended during this first stage of development.

However, as development of charge pattern 450 continues, first toner 158 in edge proximate portion 492 accumulates and an accumulated charge of first toner 158 begins to offset the influence of inter-area field 460. This reduces the strength of inter-area field 160 so that during a second stage of development there is more balanced development of first toner 158 between edge proximate portion 492 and remaining portion 490. As is shown in FIG. 9D, first toner image 482 is an example of a toner image that can form during this second stage and has a better balance between the amount of first toner 158 in remaining portion 490 and the amount of first toner 158 in edge proximate portion 492 but with a predominant amount of development continuing in edge proximate portion 492.

Continuing development of first area 452 can form an accumulation of charged first toner 158 in edge adjacent portion 492 that can have the effect of further reducing or neutralizing the influence of inter-area field 460 and therefore reducing the strength of the field that urges first toner 158 to develop in edge adjacent portion 492. This can cause development of first toner 158 between edge proximate portion 492 and remaining portion 490 to cease favoring development in edge adjacent portion 492. First toner image 484 shown in FIG. 9D illustrates one example of such a first toner image that can emerge when partial development charge pattern 450 continues to this stage.

In accordance with the method of FIG. 8, development with first toner 158 is only partially completed so that first toner 158 forms a first toner image such as any of first toner image 480, 482 or 484 having at least 15% more first toner per unit area in the edge proximate portion 492 of the first area 452 than in a remaining portion 490 of first area 452 (step 404).

There is a variety of ways in which development of first toner 158 can be made to provide partial development. For example, in one embodiment, at least one of a concentration of first toner 158, an amount of time allowed for development of a charge pattern 450 using first toner 158, a conductivity of a developer in which first toner 158 is prepared for development, or a rate of rotation of a rotating magnetic core used to induce development enhancing behavior in the developer (as is known in the art) are reduced to limit the extent to which first toner 158 develops. In one embodiment, printer controller 82 causes one or more of these conditions to occur.

In other embodiments, a distance between a source of first toner 158 such as toning shell 142 and primary imaging member 112 can be set to limit the extent to which first toner 158 develops the charge pattern. In still other embodiments, a conductivity of a carrier (not shown), or a delivery or a rate at which first toner 158 is supplied for development can be modified to provide controlled partial development of first toner 158. Here too, in one embodiment, printer controller 82 controls first development system 140 to cause such effects. Such approaches to allow first development system 140 to provide a partial development of first toner 158 can be implemented manually or automatically by way of control of appropriate sensors and actuators by printer controller 82.

Charge pattern 450 and the first toner image 480 are further developed with a second toner 208 having the first polarity. This development is done using a second development field that urges the second toner to develop in the first area in amounts that increase with increases in a difference of potential between a second bias voltage and the first imagewise modulated surface potential modified by the charge of the first toner developed in the first area to urge the second toner to develop predominately in the remaining portion of the first area that is not proximate the edge (step 406).

Figure 10:
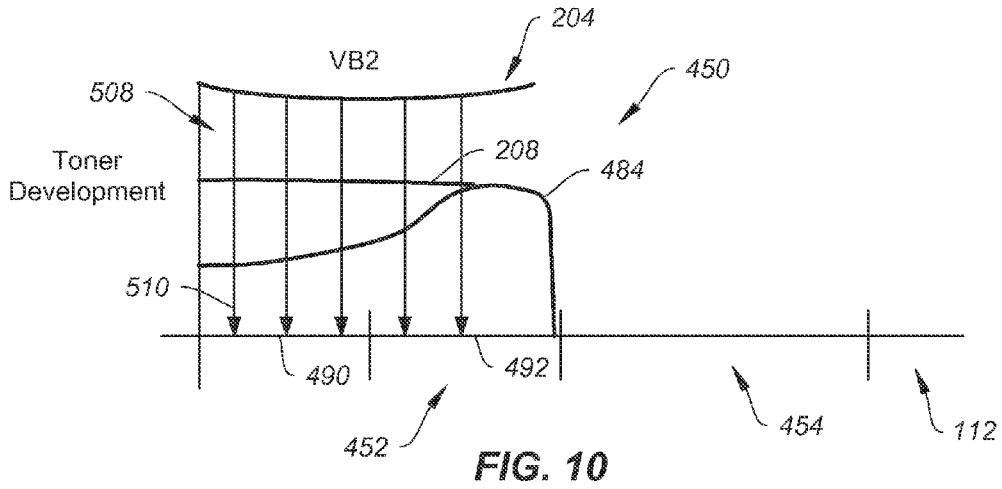
FIG. 10 illustrates development of a second toner with a first toner that has been developed as illustrated in FIGS. 9A-9D.

FIG. 10 shows an example of a second development of charge pattern 450 and first toner image 484 as shown and described in FIGS. 9A-9C. During second development, second toning shell 204 has a second bias voltage VB2 relative to ground with a polarity that matches the polarity of first toner 158 and second toner 208. In this example, second bias voltage VB2 is the same as first bias voltage VB1. As second toning shell 204 and first area 452 are brought into proximity a second development field 508 represented graphically by field lines 510 comes into being. Here too, inter-area field 460 may encourage some additional development of second toner 208 in edge adjacent portion 492 however, as is noted above this effect is significantly attenuated by the presence of charged first toner 158 in edge adjacent portion 492 and may have a negligible effect.

As is shown in this embodiment, during second development an amount of second toner 208 that is developed will reflect the second net development difference of potential VNET2 which in turn will reflect the image modulated surface potential VEPL(492) of first engine pixel location 452 less any surface potential provided by the charge of any first toner 158. Accordingly, second toner 208 will develop in first area 452 in quantities that are inversely proportional to the quantities of first toner 158 previously developed. This allows second toner 208 to develop to form a second toner image 25 having a size that is smaller than the size of first area 452 or having a shape that is different than a shape or a size of first area 452.

First toner 158 and second toner 208 are then fused to the receiver (step 408) and optionally finished (step 410). These steps can be performed in any conventional manner.

Figure 11A:
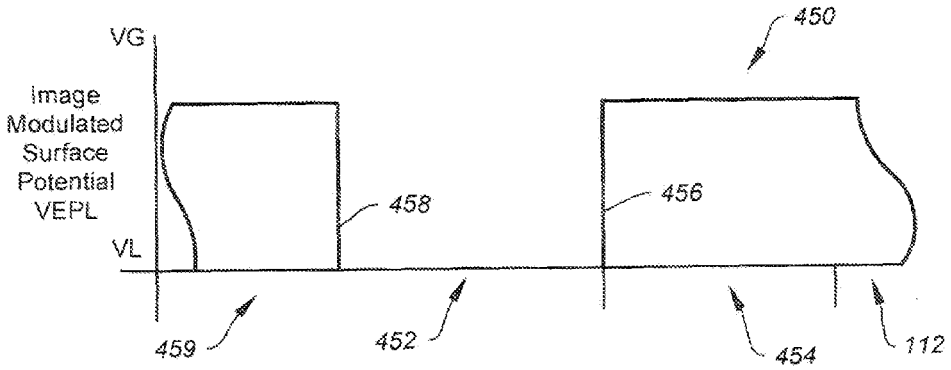
FIGS. 11A-11C illustrates the effects that multiple fields along multiple edges of an engine pixel location have on development of a first toner and a second toner.

It will be appreciated that such inter-area fields can arise along any edge of an area on a primary imaging member 112 and can cause first toner 158 to show enhanced development along any edge. For example, as is shown in FIG. 11A, a charge pattern 450 can have two opposing edges, an edge 456 separating first area 452 from second area 454 having an imagewise modulated surface potential VEPL (454) of higher level VG and an edge 458 separating first area 452 from a third area 459 having an image modulated surface potential VEPL (459) that is also at the higher level VG. As is shown in FIG. 11B which provides a top view of a primary imaging member 112 after development with first toner 158, charge pattern 450 can extend along a length L of a primary imaging member 112.

Figure 11B:
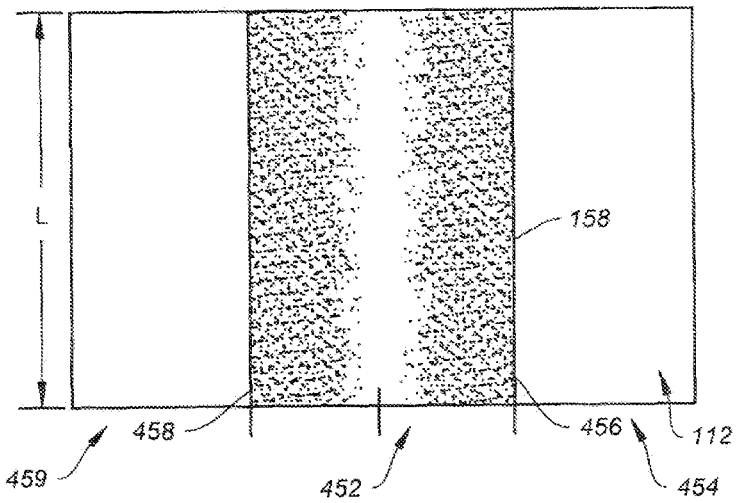
Figure 11C:
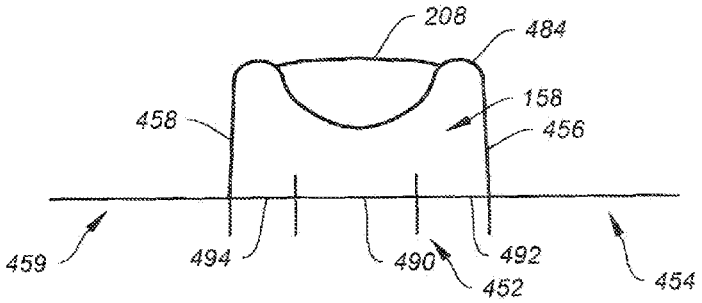

As is shown in FIG. 11C, partial development of charge pattern 450 with a first toner 158 develops in a portion 492 of first area 452 that is near edge 456 as is described with reference to FIGS. 9A-9D such that after partial development of first toner 158, the difference in an amount of first toner 158 per unit area in an edge proximate portion 492 should be at least about 15% greater than the amount that deposits in a remaining portion 490. Similarly, during partial development with first toner 158, first toner 158 develops in a portion 494 of first area 452 near edge 456 such that after partial development of first toner 158, the difference between an amount of first toner 158 per unit area in a second edge proximate portion 494 should be at least about 15% greater than an amount of first toner 158 that forms in a remaining portion 490.

As can also be seen in FIG. 11B and in cross-section in FIG. 11C, when second toner 208, shown here for the purposes of illustration only as a clear toner, is further developed onto the primary imaging member 112, second toner 208 develops predominantly in a center portion of first area 452 corresponding to remaining portions 490 with the first toner 158 providing perimeter shape within which the second toner can be developed.

Similarly, FIGS. 12A-12H illustrate the ways in which inter-area field effects can be created in a first area 610 that is surrounded by second areas 602, 604, 606, 608, 612, 614, 616, and 618. In the examples of FIGS. 12A-12H, various different charge patterns 450A-450H are illustrated. Second areas that have an imagewise modulated surface potential that is at least 30 percent greater than an image modulated surface potential of first area 610 are designated with VG. As will be shown in FIGS. 12A-12H by selectively causing one or more of second areas 602, 604, 606, 608, 612, 614, 616, and 618 to have an image modulated surface potential that is 30 percent greater than the image modulated surface potential of first area 610 can create any of a variety of effects in first area 610.

The effects shown in these illustrations are visible effects that arise after partial development a first toner 158 which is illustrated as a dark toner and a further development using a second toner 208 which is illustrated as a white toner in first area 610.

Figure 12A:
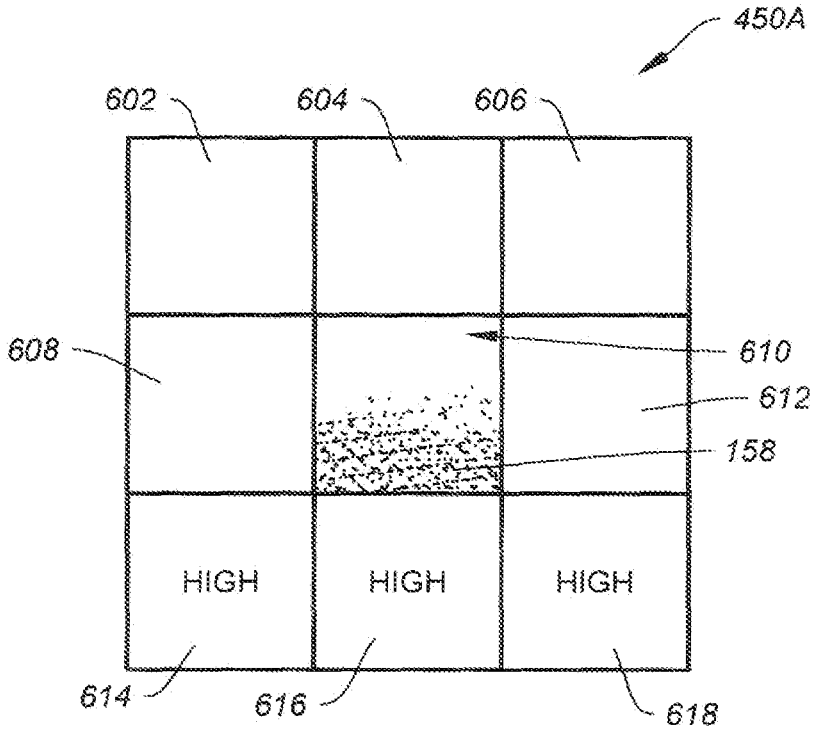
FIGS. 12A-12H illustrates the effects that multiple fields along multiple edges of an engine pixel location have on development of a first toner and a second toner.

As is shown in FIG. 12A in one embodiment, a charge pattern 450A is formed on a primary imaging member 112 that has areas 614, 616 and 618 with image modulated surface potentials VEPL(614), VEPL(616), and VEPL(618) respectively that are more than 30 percent greater than the image modulated surface potential VEPL(610) at area 610. This creates a field in area 610 that causes first toner 158 to develop principally in portions of engine pixel location 610 that are proximate to engine pixel locations 614, 616, and 618. When partial development of a dark first toner 158 is further developed using a white second toner 208 and fused a gradient is formed across engine pixel location 610 with the darker first toner 158 positioned proximate to locations 614, 616, and 618 having the appearance of gradually transitioning to lighter portions of location 610 that are along an edge of engine pixel location 610 that is adjacent engine pixel locations 602, 604, and 606.

Figure 12B:
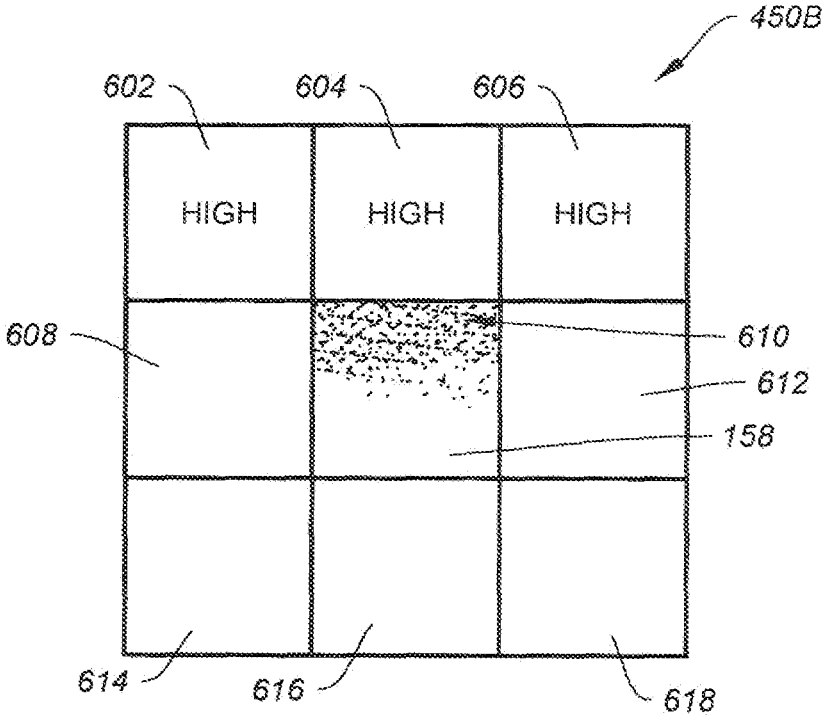
Figure 12C:
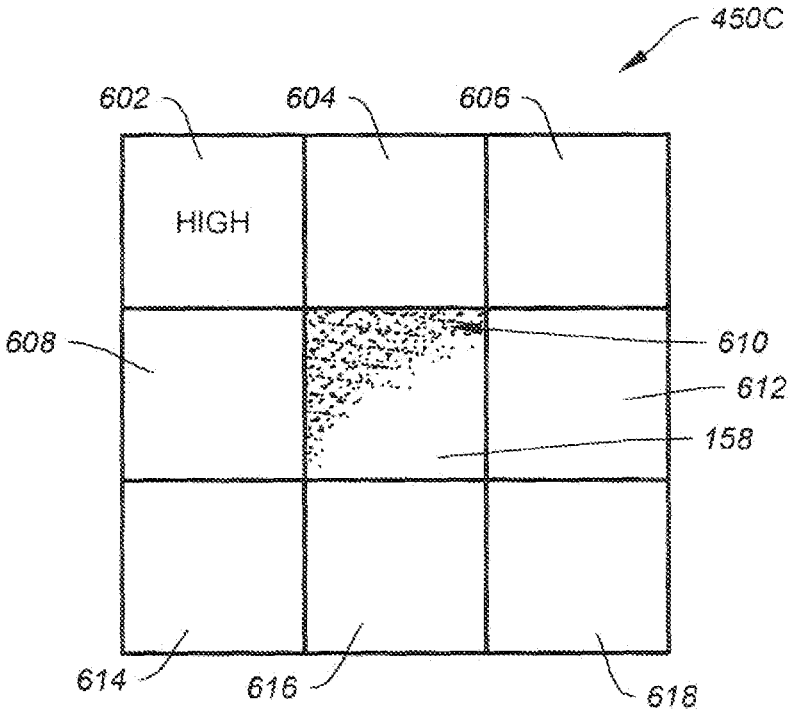
Figure 12D:
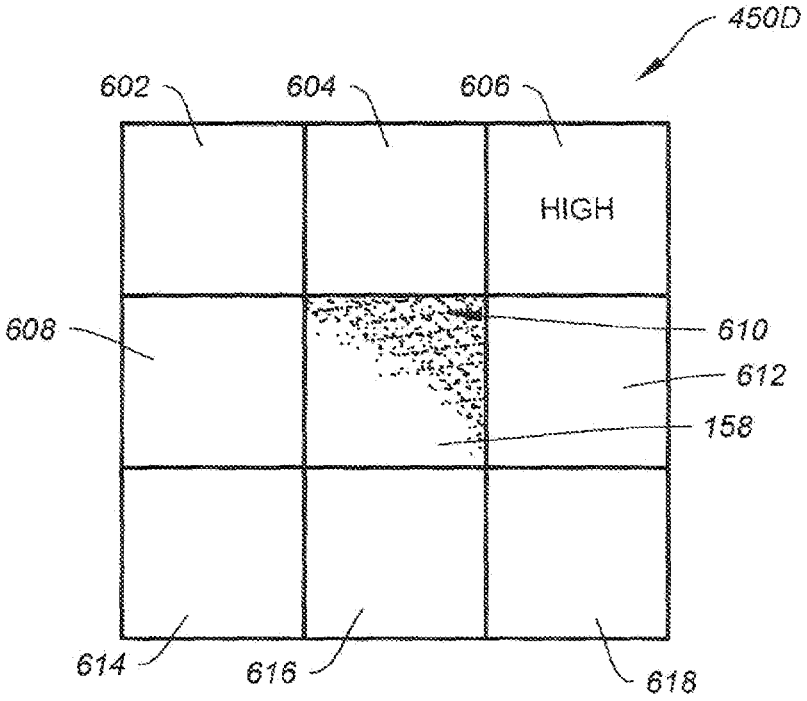
Figure 12E:
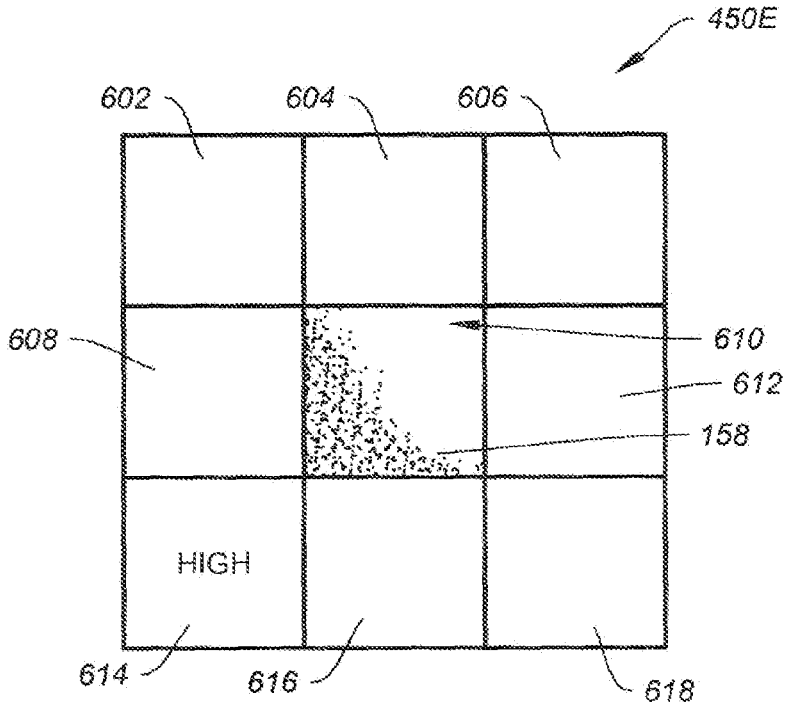
Figure 12F:
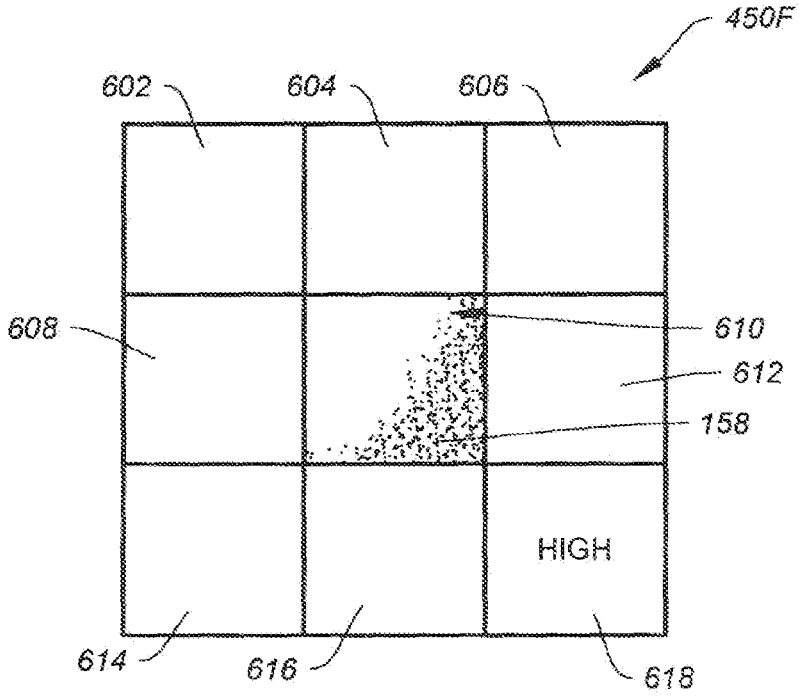

Similarly, as is shown in FIG. 12B, when another example charge pattern 450B is provided on a primary imaging member 112, thus engine pixel location 610 with an image modulated surface potential VEPL(610) that is at least about 30 percent lower than the image modulated surface potentials VEPL(602), VEPL(604) and VEPL(606) at engine pixel locations 602, 604, and 606 respectively. As can be seen in FIG. 12B first toner 158 develops along portions of engine pixel location 610 that are near engine pixel locations 602, 604, 606 so that partial development of a first toner 158 followed by development of a white second toner 208 and after fusing forms a density gradient across engine pixel location 610 with the lighter portions of engine pixel location 610 positioned proximate to locations 614, 616, and 618 while darker portions of location 610 can be found along an edge of engine pixel location 610 that is adjacent engine pixel locations 602, 604, 606 and 608. Here too, a smooth continuous gradient provides a transition from darker portions of engine pixel location 610 to lighter portions of engine pixel location 610.

In FIGS. 12C, 12D, 12E, and 12F, other example charge patterns 450C-450F are provided on a primary imaging member 112 having only one of the areas surrounding engine pixel location 610 with an image modulated surface potential VEPL that is at least 30 percent greater than the image modulated surface potential VEPL 606. As is shown in FIGS. 12C, 12D, 12E and 12F these are positioned in corners surrounding engine pixel location 610. After partial development of a dark first toner 158 followed by development of a white second toner 208 and after fusing it concentrated areas of dark toner are provided a corner of engine pixel location 610 proximate to the with a generally smooth and continuous gradient therebetween.

Figure 12G:
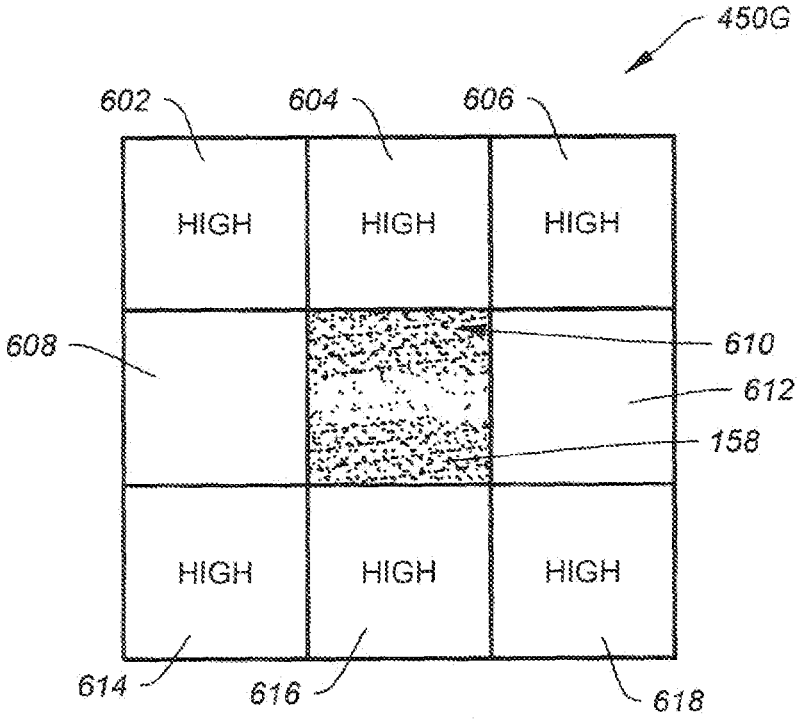

FIG. 12G illustrates charge pattern 450G provided on a primary imaging member 112 that enables the creation of parallel lines of first toner 158 separated by a second toner 208. This effect is created by providing engine pixel locations 602, 604, 606, 614, 616, and 618 with an image modulated surface potential VEPL that is at least 30 percent higher than the image modulated surface potential at engine pixel location 610 then partially developing charge pattern 450G with dark first toner 158 followed by development of white second toner 208 and fusing.

Figure 12H:
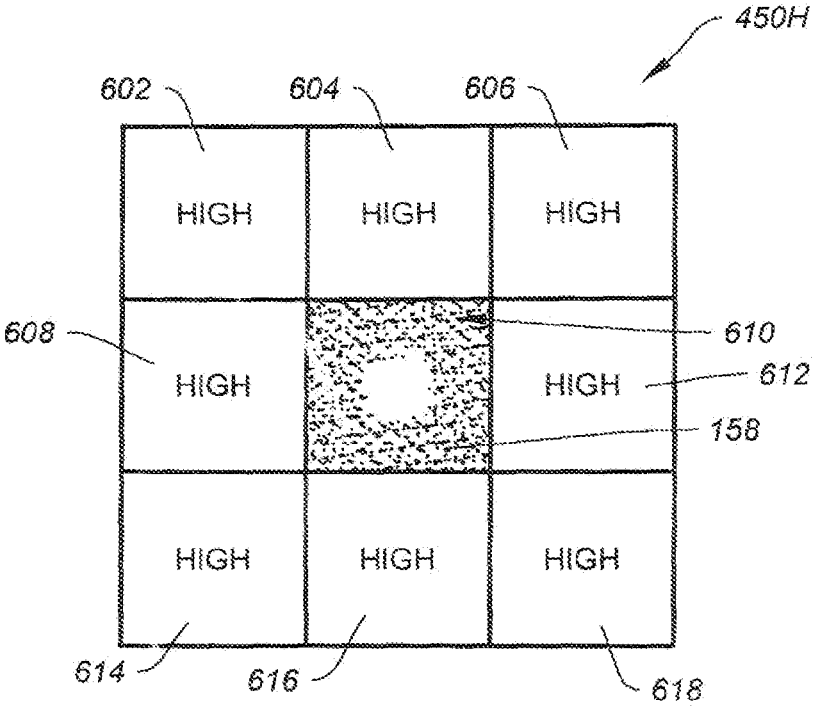

In the example that is shown in FIG. 12H, another example charge pattern 45011 is provided on a primary imaging member 112 having a first area 610 that is surrounded by areas 602, 604, 606, 608, 610, 612, 614, and 616 having image modulated surface potentials that are at least 30 percent greater than the image modulated surface potential VEPL(610) of image modulated surface potential 610. As is shown in FIG. 12H after partially developing engine pixel location 610 with a dark first toner 158 and further developing with a white second toner 208, and after fusing, engine pixel location 610 has a dark perimeter portion of first toner 158 with a lighter center portion.

It will be appreciated that by partially developing any of charge patterns 450A-450H using white first toner 158 followed with development of a dark second toner 208 and fusing, it is possible to reverse each of the effects illustrated in FIGS. 12A-1211.

There are a variety of other ways in which the method of FIG. 8 can be used advantageously in toner printing. In one example embodiment, toner printing can be used to provide a controlled gradient of a first toner 158 and a second toner 208 within an area.

In the examples that are discussed above the first bias potential VB1 and the second bias potential VB2 have been described as being less than the initial surface charge VI. This prevents development of first toner 158 and second toner 208 in second area 454 or third area 459 if VNET1 and VNET2 have sufficiently negative values, however, this is optional.

Figure 13:
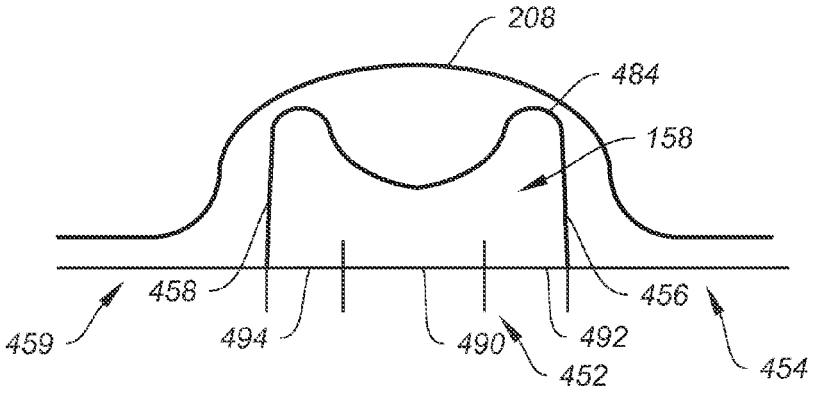
FIG. 13 illustrates yet another embodiment of a first toner and a second toner developed according to one embodiment.

In other embodiments the second bias voltage VD2 can be greater that the first bias potential VB1 and the greater imagewise modulated surface potential VG. FIG. 13 illustrates the example of the embodiment of FIG. 11C where second toner 208 is developed using a second bias voltage VB2 that is greater than a first bias voltage VB1 and greater than the greater imagewise modulated surface potential VG. As is shown in this example, second toner 208 overcoats first toner 158 and further coats second area 454 and third area 459 while also acting as described above with reference to FIG. 11C and without disrupting the appearance of the pattern formed using first toner.

It will be appreciated that in the above described embodiments various charge patterns have been shown that enable the creation of various effects in the arrangement of a first toner and a second toner in a first area. In some cases, it may be that the image data to be printed includes image elements that induce such effects. In other cases, the process of determining a chart pattern can include a step of creating edges that are not incorporated in the image data to be printed with such edges being provided to create field gradients that form specific image effects in a printed image. Such created edges can be introduced automatically or manually. In one embodiment, printer controller 82 can detect areas of image data to be printed that include gradients and cause charge patterns to be developed that provide gradients within such areas that have improved smoothness by virtue of the use of field gradients such as those described so that smooth transitions can be made between density levels within a gradient forming area of an image.

In the embodiments described above, second toner 208 has been described as being applied onto one or more first toners 158. First toner 158 is referred to in various places as a color toner, or as a toner that provides differently colored toners or that form images according to color separation images. This has been done for convenience only and is not limiting. A first toner 158 can be applied according to any type of image or pattern and the color of the first toner 158 is not critical. Without limitation, a first toner 158 can be applied according to any first toner pattern such as a pattern that defines a structure that is to be formed on receiver 26 or an arrangement of toners that are of a type or that are applied in patterns that are intended to achieve functional outcomes such as forming structures, optical elements, electrical circuit components or circuits or desirable arrangements of biological material or components thereof.

The invention has been described in detail with particular reference to certain preferred embodiments thereof, but it will be understood that variations and modifications can be effected within the spirit and scope of the invention.

What is claimed is:

1. A printer comprising:

a print engine having a primary imaging member on which a charge pattern can be formed, primary imaging system generating the charge pattern of a first polarity on a primary imaging member including a first area having a first imagewise modulated surface potential relative to ground and a second area having an imagewise modulated surface potential relative to ground that is at least about 30% greater than the first image modulated surface potential so that an inter-area field forms having a component that extends from the second area into an edge proximate portion of the first area;

a first development system partially developing the charge pattern with a first toner having a first polarity using a first development field to urge the first toner to develop in the first area in amounts that increase with increases in a first net development difference of potential between a first bias voltage at a first development station and a first imagewise modulated surface potential in the first area with the component of the inter-area field that extends into the first area further urging development of first toner in the edge proximate portion of the first area so that there is at least 15% more first toner per unit area in the edge proximate portion of the first area than in a remaining portion of the first area; and a second development system further developing the charge pattern and a first toner image with a second toner having the first polarity using a second development field that urges the second toner to develop in the first area in amounts that increase with increases in a difference of potential between a second bias voltage and the first surface potential which is modulated by the charge of the first toner developed in the first area to urge the second toner to develop predominately in the remaining portion of the first area wherein the first toner and the second toner are different.

2. The printer of claim 1, wherein primary imaging system forms the charge pattern by defining a surface potential for each of a plurality of smallest individually addressable engine pixel locations and wherein the first area comprises one of the smallest individually addressable engine pixel locations.

3. The printer of claim 1, wherein the presence of the first toner image during development of the second toner causes said second toner to form a second toner image within the first area that is smaller than the first area within which the second toner image is formed.

4. The printer of claim 1, wherein the first area has a shape and the presence of the first toner image during development of the second toner causes the second toner image to have a shape that is different from shape of the engine pixel location.

5. The printer of claim 1, wherein at least one of a concentration of a toner, a development time, a conductivity of a developer in which first toner is positioned, or a rate of rotation of a rotating magnetic core used to induce development enhancing behavior in the developer are reduced to limit the extent to which first toner develops.

6. The printer of claim 1, wherein a distance between a toning shell used to develop the first toner and primary imaging member is increased in order to provide partial development of the charge pattern.

7. The printer of claim 1, wherein the first toner is provided for development at a rate that causes the first toner to partially develop the charge pattern.

8. The printer of claim 1, further comprising a controller that is adapted to determine the charge pattern by modifying image data for the image to be printed and to create differences between a surface potential at the first area and the surface potential at the a second area that are provided to control the component of the inter-area field that extends into the edge proximate portion.

9. The printer of claim 1, further comprising a controller that is adapted to determine the charge pattern based upon image data to be printed and modified to cause the component of the inter-area field to cause the first toner and the second toner to form a gradient in the first area.

10. The printer of claim 1, further comprising a controller that is adapted to determine the charge pattern based upon image data to be printed modified a first toner pattern has a channel therein in which the second toner can develop.

11. The printer of claim 1, further comprising a controller that is adapted to determine the charge pattern based on the image data to be printed modified so that a first toner image has perimeter shape within which the second toner can be developed.

12. The printer of claim 1, wherein the component of the inter-area field that extends into the first area is strongest proximate to an edge between the first area and the second area and progressively weakens along a gradient at points that are progressively more distant from the edge.

13. The printer of claim 1, wherein the first toner and second toner are different in color.

14. The printer of claim 1, where the first toner and second toner are different in size.

15. The printer of claim 1, wherein the first toner and the second toner have different optical properties.

16. The printer of claim 1, wherein the first toner and the second toner have different mechanical properties.

17. The printer of claim 1, wherein the first toner and the second toner have different electrical properties.

18. The printer of claim 1, wherein the first toner and the second toner have a different chemical composition.

19. The printer of claim 1, wherein the first toner and the second toner have different chemical properties.

* * * * *